US006693616B2

(12) United States Patent
Koyama et al.

(10) Patent No.: US 6,693,616 B2
(45) Date of Patent: Feb. 17, 2004

(54) IMAGE DISPLAY DEVICE, METHOD OF DRIVING THEREOF, AND ELECTRONIC EQUIPMENT

(75) Inventors: Jun Koyama, Kanagawa (JP); Munehiro Azami, Kanagawa (JP); Yasushi Kubota, Nara (JP); Hajime Washio, Nara (JP)

(73) Assignee: Semiconductor Energy Laboratory Co., Ltd., Atsugi (JP)

( * ) Notice: Subject to any disclaimer, the term of this patent is extended or adjusted under 35 U.S.C. 154(b) by 311 days.

(21) Appl. No.: 09/782,260

(22) Filed: Feb. 14, 2001

(65) Prior Publication Data

US 2001/0022581 A1 Sep. 20, 2001

(30) Foreign Application Priority Data

Feb. 18, 2000 (JP) ..... 2000-041864

(51) Int. Cl.[7] ..... G09G 3/36
(52) U.S. Cl. ..... 345/98; 345/87
(58) Field of Search ..... 345/98–100, 204–206, 345/211–213, 87–97, 55–59, 76–82

(56) References Cited

U.S. PATENT DOCUMENTS 5,017,914 A * 5/1991 Uchida et al. ..... 345/89
5,170,158 A * 12/1992 Shinya ..... 345/98
5,643,826 A 7/1997 Ohtani et al. ..... 437/88
5,923,962 A 7/1999 Ohtani et al. ..... 438/150
6,147,667 A * 11/2000 Yamazaki et al. ..... 345/92
6,268,841 B1 * 7/2001 Cairns et al. ..... 345/98
6,275,210 B1 * 8/2001 Maekawa ..... 345/98
6,392,354 B1 * 5/2002 Matsueda ..... 315/169.1

FOREIGN PATENT DOCUMENTS

EP 0 837 446 A1 * 4/1998

OTHER PUBLICATIONS

Japanese Patent Application Laid–Open No. 07–130652 (English Abstract attached).

* cited by examiner

*Primary Examiner*—Richard Hjerpe
*Assistant Examiner*—Alexander Eisen
(74) *Attorney, Agent, or Firm*—Fish & Richardson P.C.

(57) ABSTRACT

The surface area occupied by a digital type signal line driver circuit in an image display device is large, and this is an impediment to reducing the size of the display device. A memory circuit within a signal line driver circuit is made common among n signal lines (where n is a natural number greater than or equal to 2). One horizontal scan period is divided into n divisions, and all signal lines can be driven by performing processing with respect to signal lines differing by memory circuit and D/A converter circuit, respectively, during the period of each division. It thus becomes possible to make 1/n as many memory circuits and D/A conversion circuits within the signal line driver circuit as in a conventional example.

45 Claims, 21 Drawing Sheets

IMAGE DISPLAY DEVICE, METHOD OF DRIVING THEREOF, AND ELECTRONIC EQUIPMENT

BACKGROUND OF THE INVENTION

1. Field of the Invention

The present invention relates to a driver circuit of an image display device to which a digital image signal is input, and more particularly, to a driver circuit capable of being formed with a reduced occupied surface area, and to an image display device and to an electronic equipment using the driver circuit.

2. Description of the Related Art

Image display devices in which a semiconductor thin film is formed over a glass substrate, and in particular, active matrix image display devices using thin film transistors (hereafter referred to as TFT) have been spreading in recent years. Active matrix image display devices using TFTs have from several hundred thousand to several million TFTs arranged in a matrix shape, which control the electric charge to each pixel.

In addition to pixel TFTs structuring pixels, polysilicon TFT technology for forming driver circuits on the outside of the pixel matrix using polysilicon TFTs formed at the same time has recently been expanding.

Furthermore, not only driver circuits corresponding to analog image signals that are formed at the same time, but also driver circuits corresponding to digital image signals have been realized.

A conventional example of an active matrix liquid crystal display device, which is one type of active matrix image display device, is shown in FIG. 19. The liquid crystal display device is structured by components such as a signal line driver circuit 101, a scanning line driver circuit 102, a pixel matrix 103, a signal line 104, a scanning line 105, a pixel TFT 106, and a liquid crystal 107, as shown in FIG. 19.

FIG. 20 is a diagram for explaining in detail a structure of a conventional example of a signal line driver circuit. Further, FIG. 21 is a timing chart corresponding to FIG. 20. An example of an image display device possessing k×l (horizontal×vertical) pixels is explained here. In order to simplify the explanation, an example of a 3-bit digital signal is used, but the digital signal is not limited to a 3 bits in an actual image display device. Furthermore, FIGS. 20 and 21 are shown using a specific example with k=640.

The conventional signal line driver circuit has the following structure. A clock signal CLK and a start pulse SP are input, and a shift register shifts the pulses one by one; a first latch circuit LAT1 which inputs a shift register output signal and stores digital image signal one by one; a second latch circuit LAT2 adjusts an output of the first latch circuit with a latch pulse; and a D/A converter circuit (DAC) converts an output of the second latch circuit to an analog signal. A latch circuit is used as the memory circuit here.

The number of the above shift register stages (corresponding to the number of DFFs shown in FIG. 20) becomes k+1 stages. The shift register output signals become control signals SR-001 to SR-640 of the first latch circuit LAT1, either directly or through a buffer. The first latch circuit LAT1 latches digital image signals D0 to D2 on digital signal lines in accordance with the control signals. It is necessary to divide the first latch circuit LAT1 into 3 digital image signal lines (the number of bits) by k (the number of horizontal signal lines) here. The second latch circuit LAT2 also must similarly be divided into 3×k.

The shift register clock signal CLK, the start pulse SP, the digital image signals D0 to D2, and a latch pulse LP are input to the signal line driver circuit. First, the start pulse SP and the clock signal CLK are input and the shift register shifts the pulses in order. The shift register output (SR-001 to SR-640 in FIG. 20) becomes shifted pulses for each clock signal CLK period, as shown in FIG. 21. The first latch circuit LAT1 operates in accordance with the shift register output signal, and the digital signal image input at this time is latched. By shifting the shift register pulse by one line portion, one line portion of the digital image signal is stored in the first latch circuit LAT1. (L1-001 to L1-640 in FIG. 20. Note that, for simplification, this is shown without differentiating bits in FIG. 20.)

Next, in a retrace period, the latch pulse LP is input, and the second latch circuit LAT2 operates in accordance with the latch pulse, and the image signal (L1-001 to L1-640 in FIG. 20 and FIG. 21) stored in the first latch circuit LAT1 becomes stored in the second latch circuit LAT2. When the retrace period is completed and the next horizontal scan period begins, the shift register again begins operation. On the other hand, the digital image signal stored in the second latch circuit LAT2 (L2-001 to L2-640 in FIG. 20 and FIG. 21. Note that, for simplicity, bit differentiation is not shown.) is converted to an analog signal by the D/A converter circuit DAC. The analog signal is sent to the signal lines (S001 to S640 in FIG. 20), and is written to the pixels when the pixel TFTs turn on.

The image display device performs write-in of the image signal to the pixels, and display, in accordance with the above operations.

A digital type driver circuit like such as that explained above has a disadvantage of occupying an extremely large surface area in comparison with an analog type driver circuit. The digital method has the merit of adjusting to two signal values, "HI" and "LO", but in exchange, the amount of data becomes enormous, and this becomes a large impediment in structuring an image display device from the standpoint of miniaturization. An increase in the surface area of an image display device invites an increase in manufacturing cost, and there is a problem of worsening profit for the manufacturing industry.

Further, along with a rapid increase in the amount of data handled in recent years, there are plans for increases in the number of pixels and in pixel definition. However, the number of driver circuits increases in accordance with the increase in number of pixels, and it is preferable to reduce the surface area of the driver circuits.

Commonly used computer display resolution examples are shown below in accordance with the name of the standard and the number of pixels.

| Number of pixels | Name of standard |
|---|---|
| 640 × 480 | VGA |
| 800 × 600 | SVGA |
| 1024 × 768 | XGA |
| 1280 × 1024 | SXGA |
| 1600 × 1200 | UXGA |

For example, in the case of the SXGA standard, if the number of bits is set to 8, then 10,240 of the first memory circuit and the second memory circuit, respectively, becomes necessary for 1280 signal lines with the above conventional driver circuit. Further, high definition television image receiving machines such as high-vision TV (HDTV) are spreading, and high definition images have become required in not only the computer world, but also in the audio-visual field. In the United States, terrestrial digital broadcasting has started, and in Japan as well, a digital broadcasting age has begun. Images having 1920×1080 pixels are strong in digital broadcasting, and therefore driver circuit miniaturization is required without delay.

SUMMARY OF THE INVENTION

However, as stated above, the surface area occupied by a signal line driver circuit is large, and this is an impediment to making image display devices smaller. In order to solve the above problems, an object of the present invention is to provide a technique advantageous in reducing the amount of surface area occupied by a signal line driver circuit, and in miniaturization.

A memory circuit and a D/A converter circuit within a signal line driver circuit are made common among n signal lines (where n is a natural number greater than or equal to 2). One horizontal scan period is divided into n divisions, and by performing processing with respect to signal lines in which the memory circuit and D/A converter circuit differ in each divided period, all signal lines can be driven normally. It thus becomes possible to reduce the number of memory circuits and D/A converter circuits within the signal line driver circuit to 1/n that of a conventional example.

DETAILED DESCRIPTION OF THE PREFERRED EMBODIMENTS

[Embodiment Mode]

An example of an image display device in which the number of pixels in a horizontal direction and in a vertical direction are taken respectively as k and l, in general is explained. A 3-bit digital image signal is explained in the embodiment mode, but the present invention is not limited to three bits, and is also effective for six bits, for eight bits, and for a larger number of bits. Further, n is used as a parameter in the following explanation for showing whether or not several signal lines are driven by one D/A converter circuit, but when the number of pixels k in the horizontal direction is not a multiple of n, a number is suitably added to k to make it a multiple of n and this is defined as a new k. In this case, provided that the added pixels are treated as virtual pixels, there are no problems to the actual operation.

Figure 1:
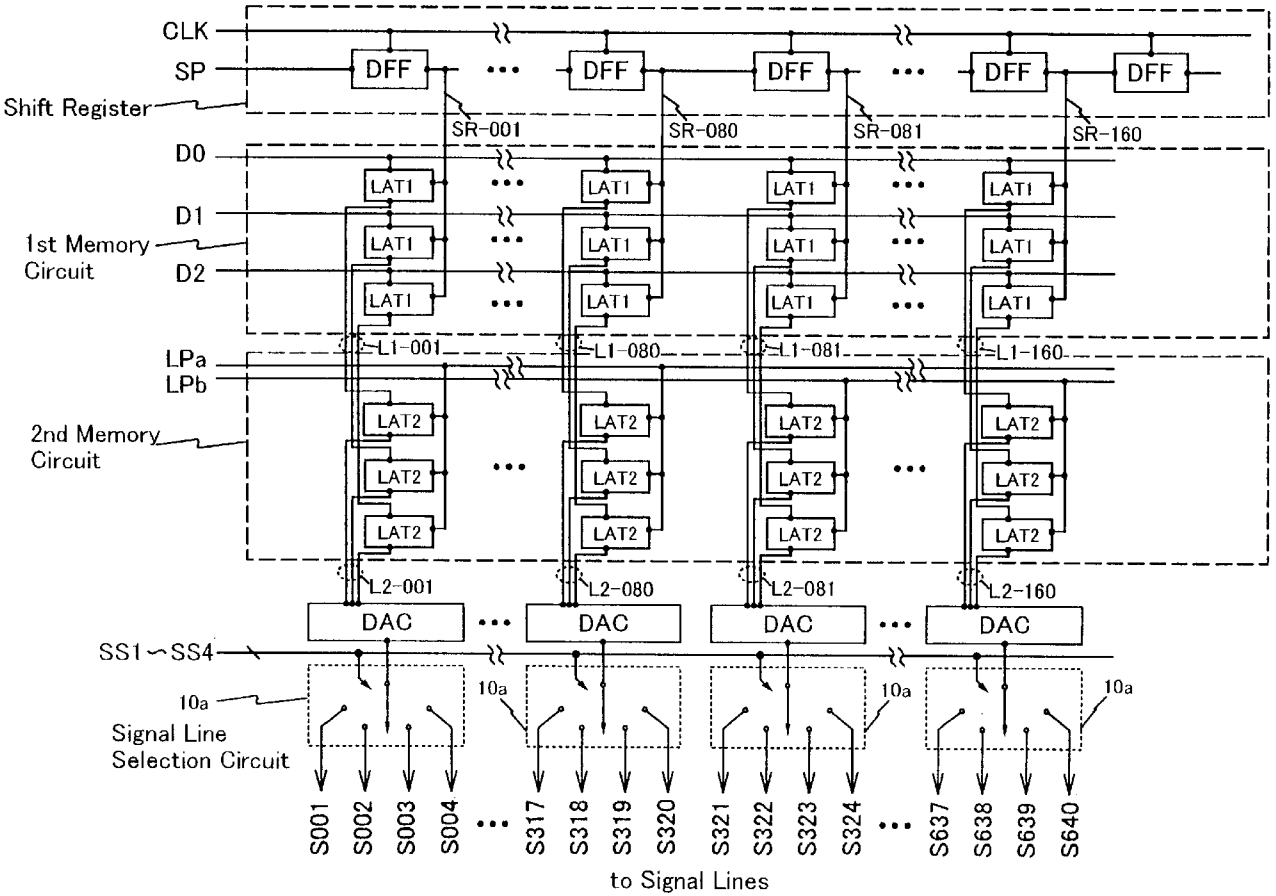
FIG. 1 is a diagram showing an example of a structure of a signal line driver circuit of the embodiment mode.
Figure 2:
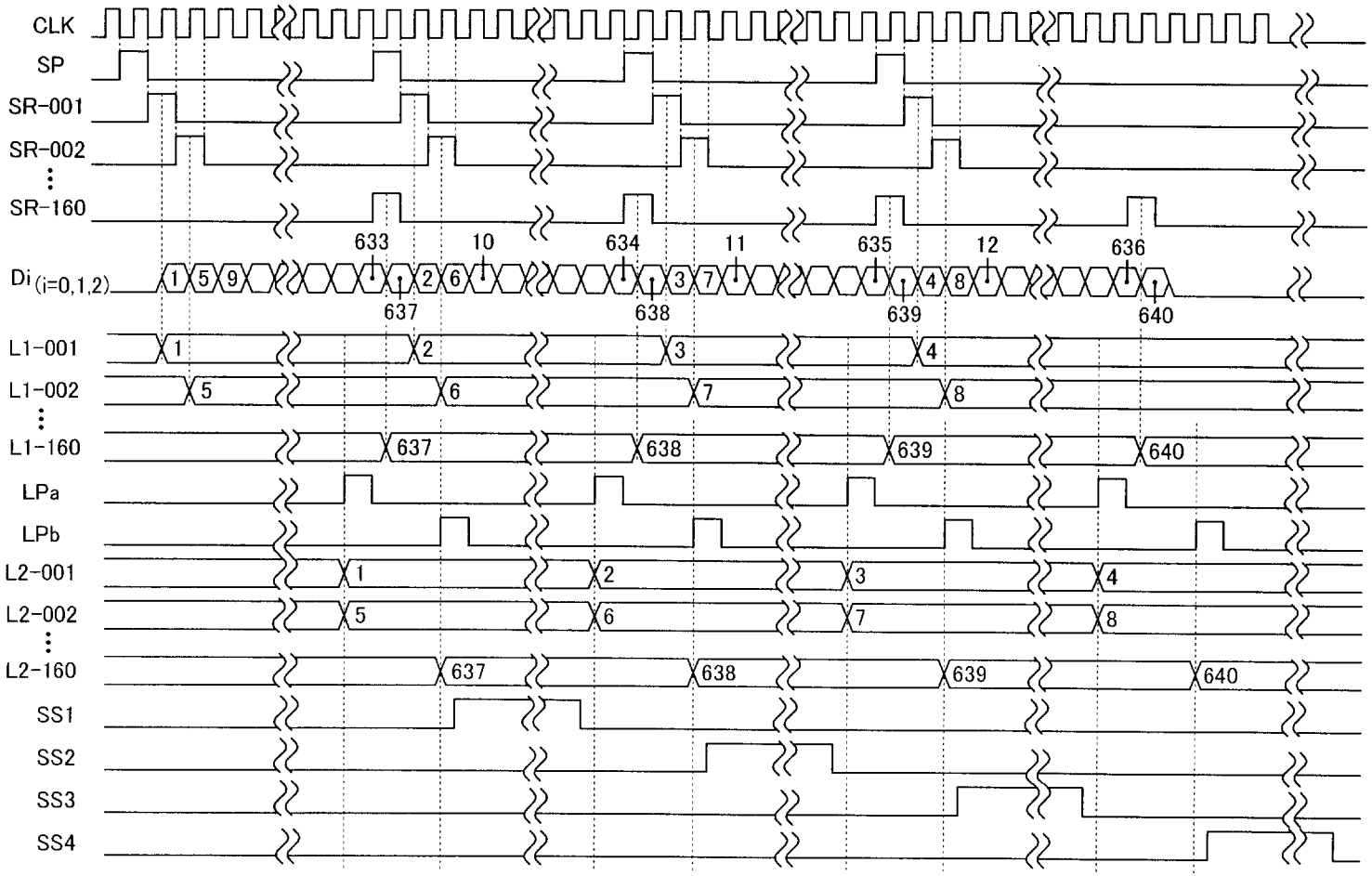
FIG. 2 is a diagram showing an operation timing of the signal line driver circuit of FIG. 1.

A structure of the embodiment mode, and its operation, are explained below. FIG. 1 shows an example of a signal line driver circuit of the embodiment mode, and FIG. 2 shows an operation timing of the signal line driver circuit. Note that a specific example with k=640 is shown in FIGS. 1 and 2. Symbols such as k are used below in order to make a general explanation, but specific values corresponding to FIGS. 1 and 2 are also shown in parenthesis. Note that the structure of a scanning line driver circuit and the structure of a pixel matrix are the same as in the conventional example.

The signal line driver circuit of the embodiment mode has a shift register composed of a delay type flip-flop DFF, a first memory circuit LAT1, a second memory circuit LAT2, a D/A converter circuit DAC, and a signal line selection circuit 10*a*. Differing from the conventional example, two types of latch signal lines LPa and LPb are supplied with FIG. 1, and the latch signal line LPa is connected to a forward portion of the second memory circuit, while the latch signal line LPb is connected to a rear portion of the second memory circuit, respectively.

As is understood from FIG. 1, the number of circuits structuring the signal line driver circuit becomes approximately 1/n (¼) the number of the conventional example. In other words, the shift register is structured by a DFF with k/n+1 stages (161 stages), 3k/n (480) each of the first memory circuit LAT1 and the second memory circuit LAT2, and k/n (160) D/A converter circuits. Note that n is a natural number greater than or equal to 2 here, and this corresponds to driving n signal lines by one D/A converter circuit. However, a specific case in which n=4 is shown in FIG. 1.

An explanation of the operation of the signal line driver circuit is made next while referring to FIG. 2. A start pulse SP and a clock signal CLK are input to the shift register.

Similar to the conventional example, the shift register shifts the pulses one by one, which are then output as digital image signal sampling pulses (shown by SR-001 to SR-160) to the first memory circuit. In contrast to one start pulse input in one horizontal scan period in the conventional example, in the embodiment mode the start pulse is input n times (4 times) in one horizontal scan period. Digital image signals D0 to D2 are stored in order in the first memory circuit (shown gathered together, without bit differentiation, as L1-001 to L1-160) in accordance with the sampling pulses output from the shift register. Also differing from the conventional example, the sequence of the digital image signals is expressed as follows, in accordance with corresponding signal line number: [1, n+1, 2n+1, . . . , k−n+1, 2, n+2, 2n+2, . . . , k−n+2, 3, n+3, 2n+3, . . . , k−n+3, 4, . . . , k] ([1, 5, 9, . . . , 637, 2, 6, 10, . . . , 638, 3, 7, 11, . . . , 639, 4, 8, 12, . . . , 640]).

Further, the number of DFF stages becomes approximately 1/n (¼) when compared to the conventional example, and differing from the conventional example the first memory circuit performs storage operation n times (4 times) during one horizontal scan period.

Regarding a latch pulse input to the second memory circuit portion during one horizontal scan period, n pulses are input to each of two types of latch signal lines LPa and LPb, for a total of 2n (8) pulses input. The latch pulse is also input during a period in which the digital image signal is input, not only during a retrace period. The latch pulse is input at the following timing in the embodiment mode.

First, a first latch pulse is input to the first latch signal line LPa after a (k/2n) (80th) stage first memory circuit completes storage operation in accordance with a sampling pulse output by a (k/2n) (80th) stage DFF generated by input of a first start pulse, and before data within a first stage first memory circuit is rewritten by a new digital image signal in accordance with a sampling pulse output from a first stage DFF generated in accordance with a second start pulse input.

Next, a second latch pulse is input to the second latch signal line LPb after a (k/n) (160th) stage first memory circuit completes storage operation in accordance with a sampling pulse output by a (k/n) (160th) stage DFF generated by input of the first start pulse, and before data within a (k/2n)+1 (81st) stage first memory circuit is rewritten by a new digital image signal in accordance with a sampling pulse output from a (k/2n)+1 (81st) stage DFF generated in accordance with the second start pulse input.

Transfer of the digital image signal corresponding to signal line numbers [1, n+1, 2n+1, . . . , k−n+1] ([1, 5, 9, . . . , 637]) to the second memory circuit is thus completed by operations up through to this point.

A third latch pulse is input at a timing which can be found by substituting "first start pulse" with "second start pulse", and by substituting "second start pulse" with "third start pulse" in the above explanation of the first latch pulse input.

Similar to the third latch pulse, a fourth latch pulse is input at a timing which can be found by substituting "first start pulse" with "second start pulse", and by substituting "second start pulse" with "third start pulse" in the above explanation of the second latch pulse input.

Transfer of the digital image signal corresponding to signal line numbers [2, n+2, 2n+2, . . . , k−n+2] ([2, 6, 10, . . . , 638]) to the second memory circuit is thus completed by operations up through this point.

In general, a number (2i−1) latch pulse is input at a timing which can be found by substituting "first start pulse" with "i-th start pulse", and by substituting "second start pulse" with "(i+1)-th start pulse" in the above explanation of the first latch pulse input. Continuing, a number (2i) latch pulse is input at a timing which can be found by substituting "first start pulse" with "i-th start pulse", and by substituting "second start pulse" with "(i+1)-th start pulse" in the above explanation of the second latch pulse input. Note that i is a natural number, and i<n.

Transfer of the digital image signal corresponding to signal line numbers [i, n+i, 2n+i, . . . , k−n+i] to the second memory circuit is thus completed by operations up through to this point.

Thus latch pulses may thus be input during one horizontal scan period, but the final (2n−1) and (2n) latch pulses are input at a timing as follows.

Namely, for the (2n−1) latch pulse, the latch pulse is input to the first latch signal line LPa after a (k/2n) (80th) stage first memory circuit completes storage operation in accordance with a sampling pulse output by a (k/2n) (80th) stage DFF generated by input of the n start pulse, and before data within the first stage first memory circuit is rewritten by a new digital image signal in accordance with a sampling pulse output from the first stage DFF generated in accordance with the fist start pulse input in the next horizontal scan period.

Next, for the (2n) latch pulse, the latch pulse is input to the second latch signal line LPb after a (k/n) (160th) stage first memory circuit completes storage operation in accordance with a sampling pulse output by a (k/n) (160th) stage DFF generated by input of the n start pulse, and before data within a (k/2n)+1 (81st) stage first memory circuit is rewritten by a new digital image signal in accordance with a sampling pulse output from a (k/2n)+1 (81st) stage DFF generated in accordance with the first start pulse in the next horizontal scan period.

Transfer of the digital image signal corresponding to numbers [n, 2n, 3n, . . . , k] ([4, 8, 12, . . . , 640]) signal lines to the second memory circuit is thus completed in accordance with these operations.

All digital image signals of one row portion of signal lines are thus transferred to the second memory circuit by input of latch pulse as above.

Note that the latch pulse is input 2n times (8 times) in one horizontal scan period in the above explanation, but the clock may be temporarily stopped after one shift register scan is completed, and the latch pulse may be input before the next scan begins. In this case, the one type of latch signal line may be used, and the latch pulse input is performed n times (4 times) during one horizontal scan period.

The second memory circuit output is input to the D/A converter circuit, and the 3-bit digital signal is converted into an analog signal. The converted analog signal is written into appropriate signal lines through the signal line selection circuit 10*a*. A timing of the write-in is explained below.

In one horizontal scan period, storage operation of the second memory circuit is repeated n times as above, in correspondence with the shift register scanning n times. Therefore, selection of a corresponding signal line, and write-in of a digital image signal corresponding to the certain signal line, must be completed during a period in which the image signal is stored in the second memory circuit.

First, within the period during which the digital image signals corresponding to signal line numbers [1, n+1, 2n+1, . . . , k−n+1] ([1, 5, 9, . . . , 637]) are stored in the second memory circuit portion, pulses are input to a first control signal line SS1 of the signal line selection circuit 10*a*, and each signal line selection circuit 10*a* selects the [1, n+1, 2n+1, . . . , k−n+1] ([1, 5, 9, . . . , 637]) number signal lines.

Next, the data within the second memory circuit is changed, and within the period during which the digital image signals corresponding to signal line numbers [2, n+2, 2n+2, . . . , k−n+2] ([2, 6, 10, . . . , 638]) are stored in the second memory circuit portion, pulses are input to a second control signal line SS2 of the signal line selection circuit 10*a*, and each signal line selection circuit 10*a* selects the [2, n+2, 2n+2, . . . , k−n+2] ([2, 6, 10, . . . , 638]) number signal lines.

In general, taking i as a natural number, pulses are input to an i-th control signal line SS1 of the signal line selection circuit 10*a*, and each signal line selection circuit 10*a* selects the [i, n+i, 2n+i, . . . , k−n+i] number signal lines within the period during which the digital image signals corresponding to signal line numbers [i, n+i, 2n+i, . . . , k−n+i] are stored in the second memory circuit portion.

Write-in of the output of the D/A converter circuit to appropriate signal lines can thus be performed in accordance with the control signal pulses input to the signal line selection circuit 10*a* n-times during one horizontal scan period.

Note that circuits such as a buffer circuit, a level shift circuit, and an enable circuit for limiting an output period may be inserted between the second memory circuit output and the D/A converter circuit. Further, the sequence of the digital image signal is not limited to the order above. The sequence may be determined in accordance with the operation method of the signal line selection circuit.

In the above explanation of the embodiment mode, a shift register is used as a circuit for controlling the first memory circuit, but in addition to the shift register, a decoder circuit may also be used. Further, a ramp type D/A converter circuit may also be used for the D/A converter circuit. In this case, the number of D/A converter circuits is not limited to k/n.

[Embodiment 1]

An example of an XGA standard image display device having 1024 pixels in a horizontal direction and 768 pixels in a vertical direction is explained in Embodiment 1. A 3-bit digital image signal is explained in Embodiment 1, but the present invention is not limited to three bits, and is also effective for six bits, for eight bits, and for a greater number of bits. Further, this example is of driving four signal lines by one D/A converter circuit.

A structure of Embodiment 1 is explained below, and thereafter the operation of Embodiment 1 is explained.

Figure 3:
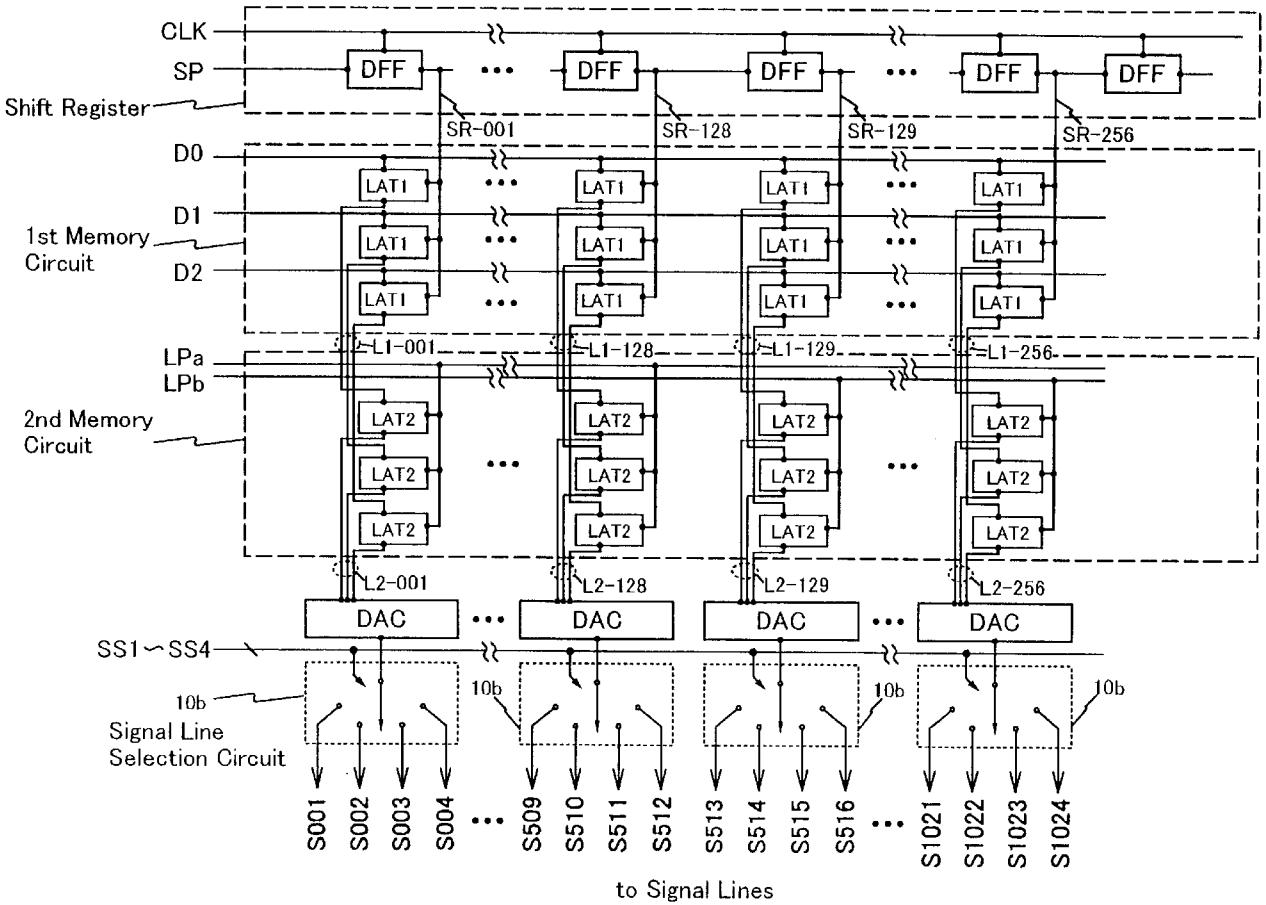
FIG. 3 is a diagram showing a structure of a signal line driver circuit of Embodiment 1.

An example of a signal line driver circuit using the present invention is shown in FIG. 3. A scanning line driver circuit structure and a pixel matrix structure are the same as conventional structures. The signal line driver circuit of Embodiment 1 has a shift register composed of a 257 stage DFF, a first memory circuit of 256×3 bits, and 256 D/A converter circuits. Further, D/A converter circuit output is connected to signal lines through a signal line selection circuit 10*b*.

A start pulse SP and a clock signal CLK are input to the shift register, and two types of latch signal lines LPa and LPb are supplied to a second memory circuit LAT2. The latch signal line LPa is connected to a forward portion of the second memory circuit, while the latch signal line LPb is connected to a rear portion of the second memory circuit, respectively. Four control signal lines SS1 to SS4 are each connected to the signal line selection circuit 10*b*.

Figure 4:
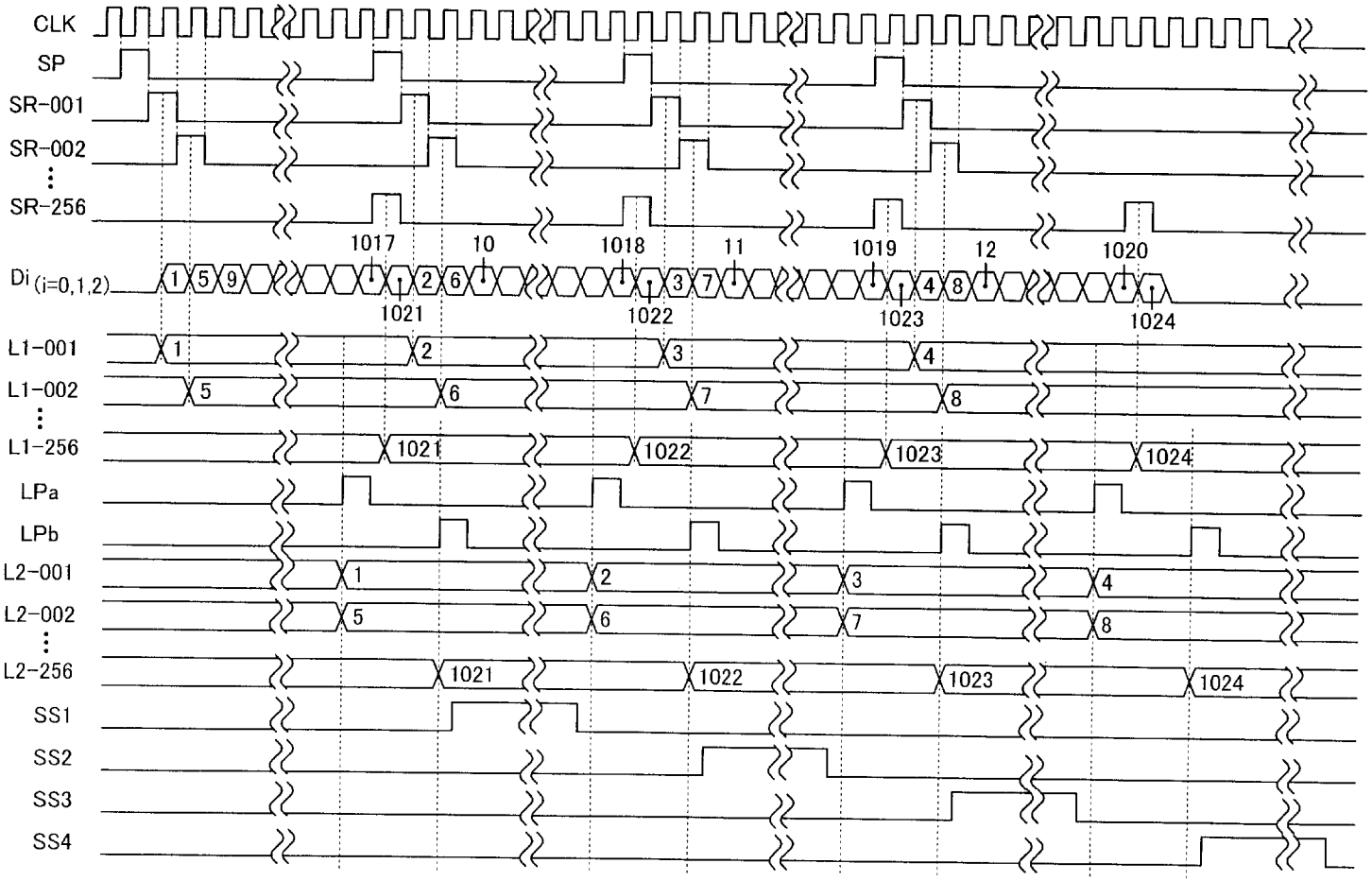
FIG. 4 is a diagram showing an operation timing of the signal line driver circuit of FIG. 3.

An explanation of the operation of the signal line driver circuit is made next with reference to FIG. 4. The start pulse SP and the clock signal CLK are input to the shift register. Similar to the conventional example, the shift register shifts the pulses one by one, which are then output as digital image signal sampling pulses (shown by SR-001 to SR-256) to the first memory circuit. In contrast to one start pulse input in one horizontal scan period in the conventional example, in Embodiment 1 the start pulse is input 4 times in one horizontal scan period. Digital image signals D0 to D2 are stored in order in the first memory circuit (shown gathered together, without bit differentiation, as L1-001 to L1-256) in accordance with the sampling pulses output form the shift register. Also differing from the conventional example, the sequence of the digital image signals is expressed as follows, in accordance with corresponding signal line number: [1, 5, 9, . . . , 1021, 2, 6, 10, . . . , 1022, 3, 5, 11, . . . , 1023, 4, 8, 12, . . . . 1024].

Further, the number of DFF stages becomes approximately ¼ when compared to the conventional example, and the first memory circuit performs storage operation 4 times during one horizontal scan period, differing from the conventional example.

Regarding a latch pulse input to the second memory circuit portion during one horizontal scan period, 4 pulses are input to each of the two types of latch signal lines LPa and LPb, for a total of 8 pulses input. The latch pulse is also input during a period in which the digital image signal is input, not only during a retrace period. The latch pulse is input at the following timing in the embodiment mode.

First, a first latch pulse is input to the first latch signal line LPa after a 128th stage first memory circuit completes storage operation in accordance with a sampling pulse output by a 128th stage DFF generated by input of a first start pulse, and before data within a first stage first memory circuit is rewritten by a new digital image signal in accordance with a sampling pulse output from a first stage DFF generated in accordance with a second start pulse input.

Next, a second latch pulse is input to the second latch signal line LPb after a 256th stage first memory circuit completes storage operation in accordance with a sampling pulse output by a 256th stage DFF generated by input of the first start pulse, and before data within a 129th stage first memory circuit is rewritten by a new digital image signal in accordance with a sampling pulse output from a 129th stage DFF generated in accordance with the second start pulse input.

Transfer of the digital image signal corresponding to signal line numbers [1, 5, 9, . . . , 1021] to the second memory circuit is thus completed by operations up through to this point.

A third latch pulse is input at a timing which can be found by substituting "first start pulse" with "second start pulse", and by substituting "second start pulse" with "third start pulse" in the above explanation of the first latch pulse input.

A fourth latch pulse is input at a timing which can be found by substituting "first start pulse" with "second start pulse", and by substituting "second start pulse" with "third start pulse" in the above explanation of the second latch pulse input.

Transfer of the digital image signal corresponding to signal line numbers [2, 6, 10, . . . , 1022] to the second memory circuit is thus completed by operations up through to this point.

In general, a number (2i−1) latch pulse is input at a timing which can be found by substituting "first start pulse" with "i-th start pulse", and by substituting "second start pulse" with "(i+1)-th start pulse" in the above explanation of the first latch pulse input. Continuing, a number (2i) latch pulse is input at a timing which can be found by substituting "first start pulse" with "i-th start pulse", and by substituting "second start pulse" with "(i+1)-th start pulse" in the above explanation of the second latch pulse input. Note that i is a natural number, and i<4.

Transfer of the digital image signal corresponding to signal line numbers [i, 4+i, 8+i, . . . , 1020+i] to the second memory circuit is thus completed by operations up through to this point.

Thus latch pulses may thus be input during one horizontal scan period, but the final 7th and 8th latch pulses are input at a timing as follows.

Namely, for the 7th latch pulse, the latch pulse is input to the first latch signal line LPa after the 128th stage first memory circuit completes storage operation in accordance with a sampling pulse output by the 128th stage DFF generated by input of a fourth start pulse, and before data within a the first stage first memory circuit is rewritten by a new digital image signal in accordance with a sampling pulse output from the first stage DFF generated in accordance with the first start pulse input.

For the final 8th latch pulse, the latch pulse is input to the second latch signal line LPb after the 256th stage first memory circuit completes storage operation in accordance with a sampling pulse output by the 256th stage DFF generated by input of the fourth start pulse, and before data within a 129th stage first memory circuit is rewritten by a new digital image signal in accordance with a sampling pulse output from a 129th stage DFF generated in accordance with the first start pulse input.

Transfer of the digital image signal corresponding to signal line number [4, 8, 12, . . . , 1024] to the second memory circuit is thus completed in accordance with these operations.

All digital image signals of one row portion of signal lines are thus transferred to the second memory circuit by the latch pulse input as above.

Note that the latch pulse is input 8 times in one horizontal scan period in the above explanation, but the clock may be temporarily stopped after one shift register scan is completed, and the latch pulse may be input before the next scan begins. In this case, one type of latch signal line may be used, and the latch pulse input is performed 4 times during one horizontal scan period.

The second memory circuit output is input to the D/A converter circuit, and the 3-bit digital signal is converted into an analog signal. The converted analog signal is written into appropriate signal lines through the signal line selection circuit 10*b*. A timing of the write-in is explained below.

In one horizontal scan period, storage operation of the second memory circuit is repeated 4 times as above, in correspondence with the shift register scanning 4 times. Therefore, selection of a corresponding signal line, and write-in of a digital image signal corresponding to the certain signal line, must be completed during a period in which the image signal is stored in the second memory circuit.

First, within the period during which the digital image signals corresponding to signal line numbers [1, 5, 9, . . . , 1021] are stored in the second memory circuit portion, pulses are input to a first control signal line SS1 of the signal line selection circuit 10*b*, and each signal line selection circuit 10*b* selects the [1, 5, 9, . . . , 1021] number signal lines, respectively.

Next, the data within the second memory circuit is changed, and within the period during which the digital image signals corresponding to signal line numbers [2, 6, 10, . . . , 1022] are stored in the second memory circuit portion, pulses are input to a second control signal line SS2 of the signal line selection circuit 10*b*, and each signal line selection circuit 10*b* selects the [2, 6, 10, . . . , 1022] number signal lines.

In general, taking i as a natural number, pulses are input to an i-th control signal line SS1 of the signal line selection circuit 10*b*, and each signal line selection circuit 10*b* selects the [i, 4+i, 8+i, . . . , 1020+i] number signal lines within the period during which the digital image signals corresponding to signal line numbers [i, 4+i, 8+i, . . . , 1020+i] are stored in the second memory circuit portion.

Write-in of the output of the D/A converter circuit to appropriate signal lines can thus be performed in accordance with the control signal pulses input to the signal line selection circuit 10*b* 4 times during one horizontal scan period.

Note that circuits such as a buffer circuit, a level shift circuit, and an enable circuit for limiting an output period may be inserted between the second memory circuit output and the D/A converter circuit.

Figure 5A:
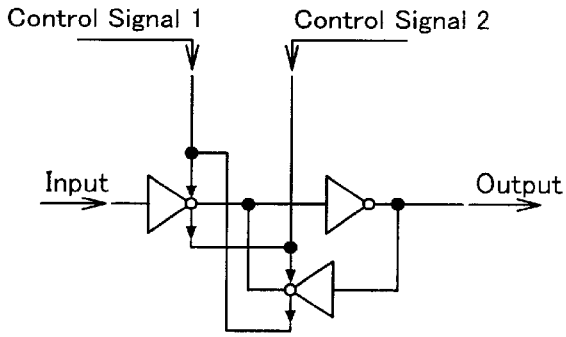
FIGS. 5A to 5C are diagrams showing specific examples of memory circuits.
Figure 5B:
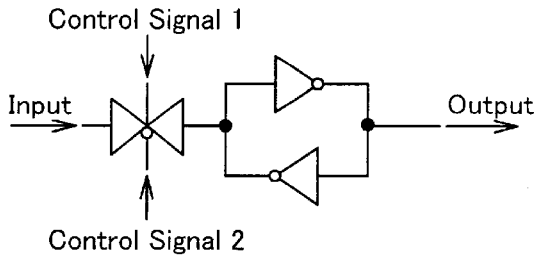
Figure 5C:
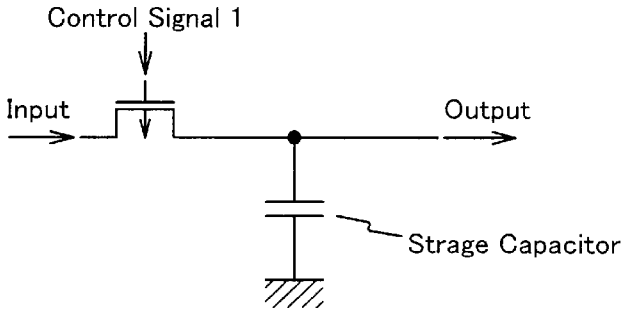

A specific example of the memory circuit is shown in FIGS. 5A to 5C. FIG. 5A is a memory circuit using a clocked inverter, FIG. 5B is an SRAM type memory circuit, and FIG. 5C is a DRAM type memory circuit. These are typical examples, and the present invention is not limited to these forms.

With the present invention, the image display device can thus be driven by one-fourth the conventional number of shift registers, one-fourth the conventional number of first memory circuits, one-fourth the number of second memory circuits, and one-fourth the number of D/A converter circuits. It becomes possible to greatly reduce the surface area occupied by the driver circuit, and it becomes possible to greatly reduce the number of elements.

In the above explanation of the embodiment, a shift register is used as a signal for controlling the first memory circuit, but in addition to the shift register, a decoder circuit may also be used.

[Embodiment 2]

Figure 6:
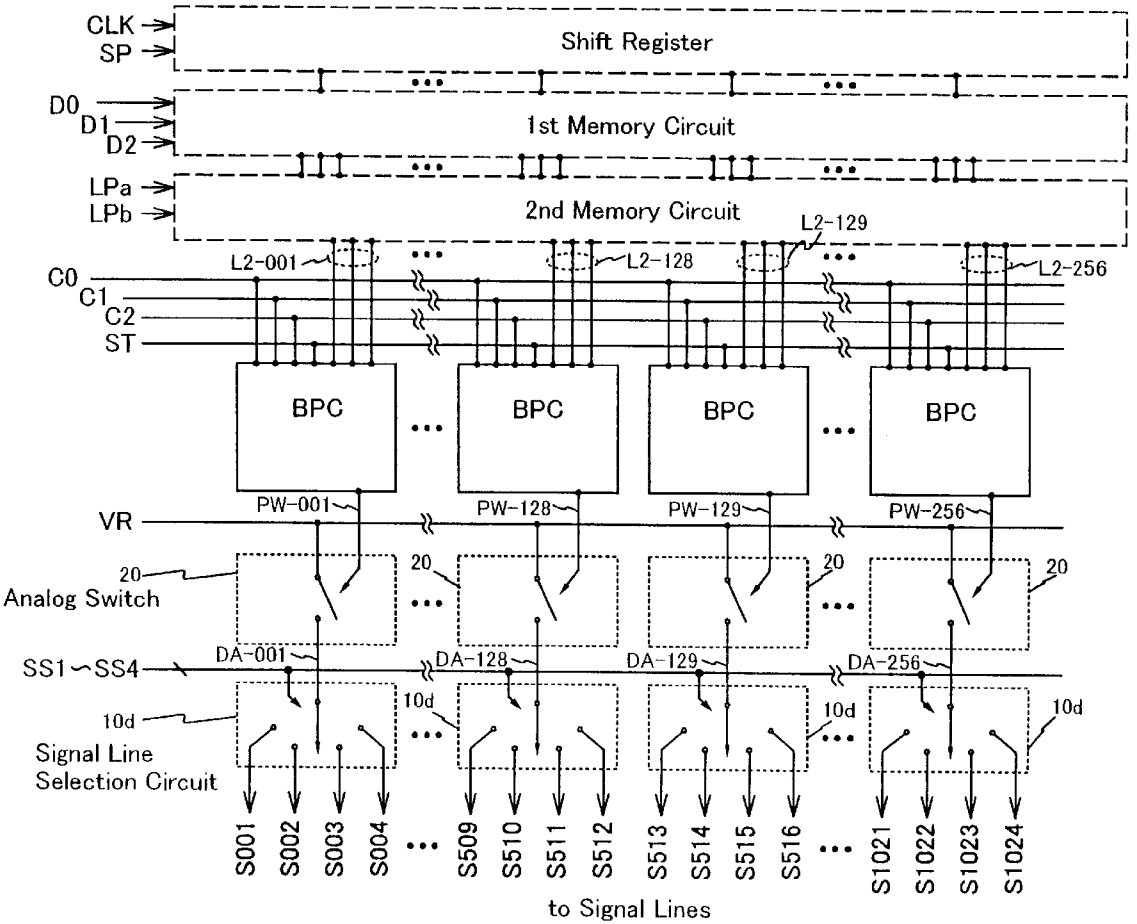
FIG. 6 is a diagram showing a structure of a signal line driver circuit of Embodiment 2.

An example of a case of employing a ramp type D/A converter circuit in a D/A converter circuit is shown in Embodiment 2. A schematic diagram of a signal line driver circuit when using a ramp type D/A converter circuit is shown in FIG. 6. Note that a case of a 3-bit digital image signal applied to an XGA standard image display device is also explained in Embodiment 2, but the present invention is not limited to three bits, and is also effective in cases corresponding to other number of bits and for image display devices having standards other than XGA.

A structure of Embodiment 2 is explained below, and its operation is explained thereafter.

Embodiment 2 is the same as Embodiment 1 from the shift register to the second memory circuit. A bit pulse-width comparison converter circuit BPC, an analog switch 20, and a signal line selection circuit 10*c* are downstream of the second memory circuit. The 3-bit digital image signal stored in the second memory circuit, count signals C0 to C2, and a set signal ST are input to the bit pulse-width comparison converter circuit BPC. Outputs PW-i of the bit pulse-width comparison converter circuit, where i is from 001 to 256, and a gray-scale voltage supply VR are input to the analog switch 20. Output of the analog switch 20 and control signals SS1 to SS4 are input to the signal line selection circuit 10*c*.

Figure 8:
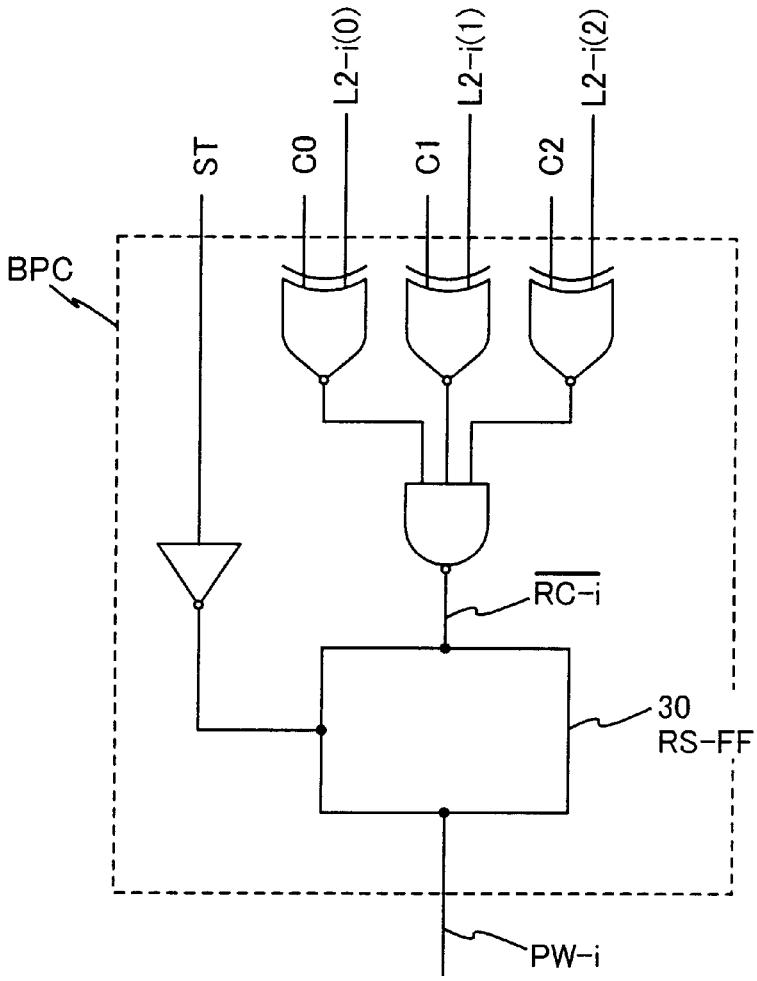
FIG. 8 is a diagram showing a structure of a bit pulse-width comparison circuit (BPC)

An example of a structure of an i-th stage of the bit pulse-width comparison converter circuit BPC is shown in FIG. 8. BPC has an exclusive OR gate, a three-input NAND gate, an inverter, and a set-reset flip-flop RS-FF. In FIG. 8, output of the i-th stage second memory circuit is differentiated by bit into L2-*i*(0), L2-*i*(1), and L2-*i*(2).

Figure 7:
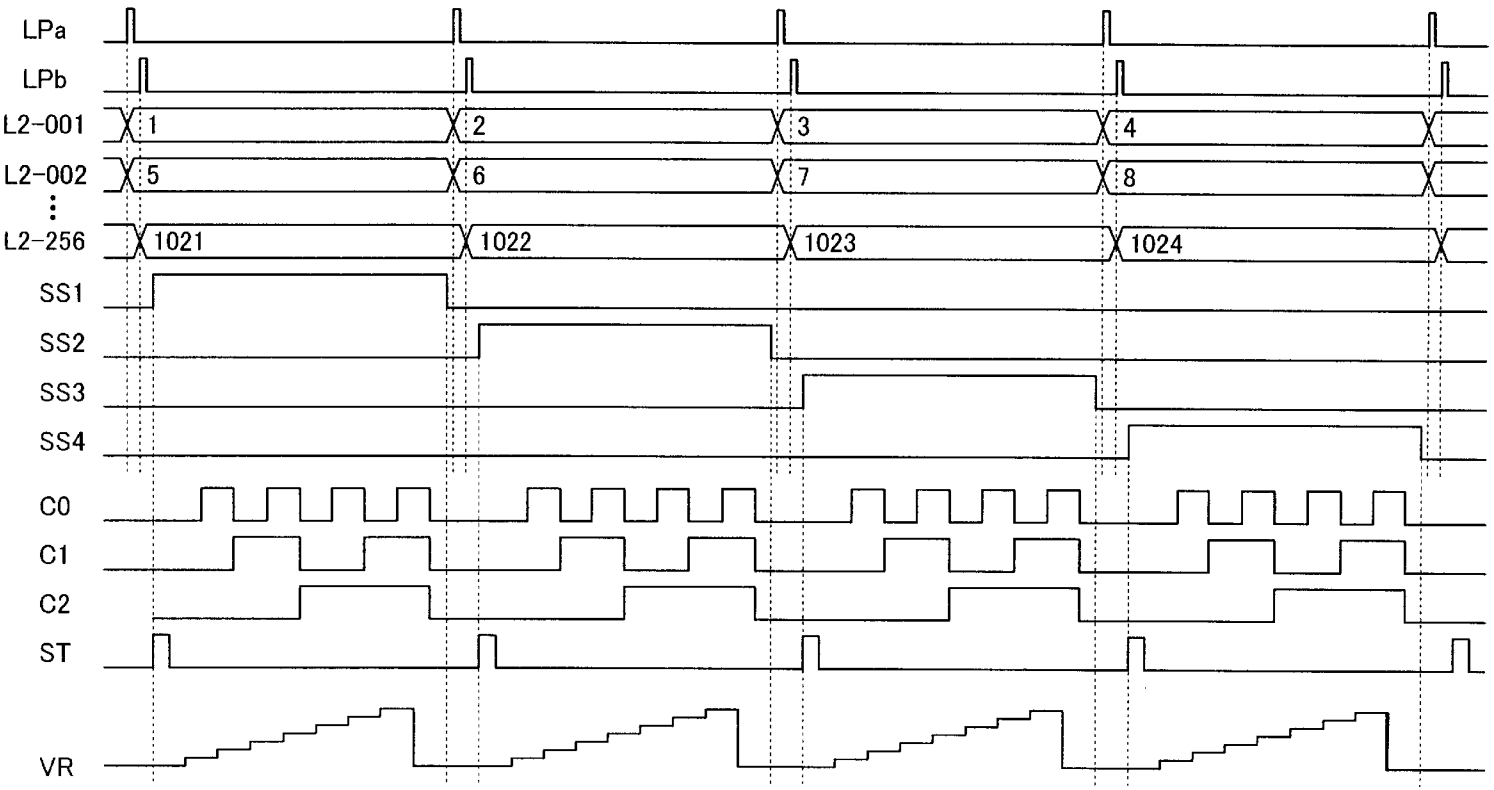
FIG. 7 is a diagram showing an operation timing of the signal line driver circuit of FIG. 6.

Operation of Embodiment 2 is explained next. An operation timing of signal systems necessary for understanding the summary of the circuit operation of FIG. 6 is shown in FIG. 7. The operation from the shift register to the second memory circuit is also the same as in Embodiment 1. Further, an explanation of the control signals SS1 to SS4 input to the signal line selection circuit 10*c* is the same as that of Embodiment 1. When the four signal lines are selected in order in accordance with the signal line selection circuit 10*c*, the count signals C0 to C2, the set signal ST, and the gray-scale voltage supply VR are periodically input. Thus write-in of information to all signal lines can be performed equivalently.

Figure 9:
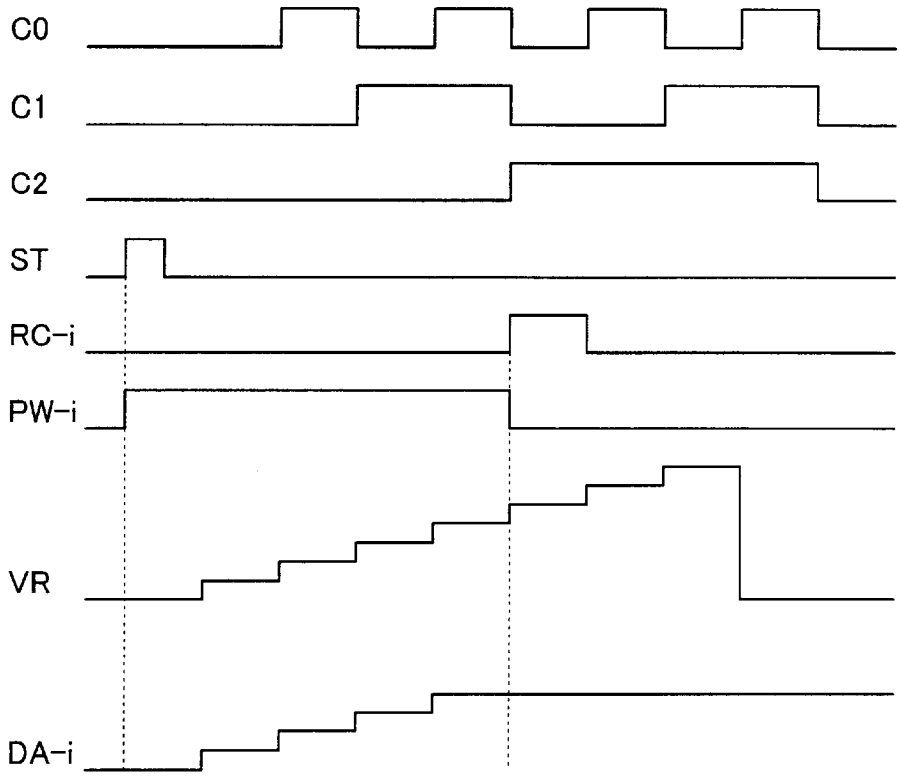
FIG. 9 is a diagram for explaining ramp-type D/A converter circuit operation.

Operation timing of a period for selecting one of the four signal lines in accordance with the signal line selection circuit is shown in FIG. 9 in order to explain the detailed operation of the ramp type D/A converter circuit. First, RS-FF30 is set in accordance with input of the set signal, and output PW-i becomes HI level. Next, the digital image signal stored in the second memory circuit is compared bit by bit with the count signals C0 to C2 in accordance with the exclusive OR gate. When all three bits are in agreement, all outputs of the exclusive OR gates become HI, and as a result, the output of the three-input NAND gate (inverted RC-i) becomes LO (therefore RC-i becomes HI). The output of the three-input NAND gate is input to RS-FF30, and when RC-i becomes HI, is reset, and the output PW-i returns to LO. An example of the output of RC-i, PW-i, and DA-i for a case when the 3-bit digital image signal {L2-*i*(0), L2-*i*(1), L2-*i*(2)} is {0, 0, 1} is shown in FIG. 9. The digital image signal information is thus converted to the pulse width of the output PW-i of the bit pulse-width comparison converter circuit BPC.

The output PW-i of the bit pulse-width comparison converter BPC is controlled by switching of the analog switch 20. The gray-scale voltage supply VR, possessing a gray-scale state voltage level synchronized to the count signals C0 to C2, is applied to the analog switch 20, and the signal line is continuous only during the interval that the output PW-i of BPC is HI, and the voltage at the instant when PW-i becomes LO is written to the signal line.

The digital image signal is converted to an analog signal and the signal line is driven in accordance with the above operations. Note that it is not necessary for the scale—scale voltage supply VR to be a gray-scale state, and a voltage supply which continuously changes monotonically may also be used. Further, circuits such as a buffer circuit and a level shift circuit may also be inserted between the output of the bit pulse-width comparison converter circuit BPC and the analog switch 20.

The ramp type D/A converter circuit can thus be used as the D/A converter circuit in the present invention. The circuit structure is approximately ¼ that of a conventional circuit, and it therefore becomes possible to greatly reduce the surface area occupied by the driver circuit, and to greatly reduce the number of elements.

[Embodiment 3]

A method of manufacturing an active matrix liquid crystal display device is employed in Embodiment 3 as an example of a specific method of manufacturing an active matrix image display device using the driver circuits explained by Embodiments 1 and 2. In particular, a method of manufacturing a pixel TFT, which is a switching element of a pixel portion, and a TFT of a driver circuit (such as a signal line driver circuit and a scanning line driver circuit) formed in the periphery of the pixel portion, on the same substrate is explained in detail in accordance with process steps. Note that in order to simplify the explanation, a CMOS circuit, which is a fundamental structure circuit of the driver circuit portion, is shown in the figures as the driver circuit portion. In addition, an n-channel TFT is shown in the figures as the pixel TFT portion.

Figures 10A, 10B, 10C, 10D:
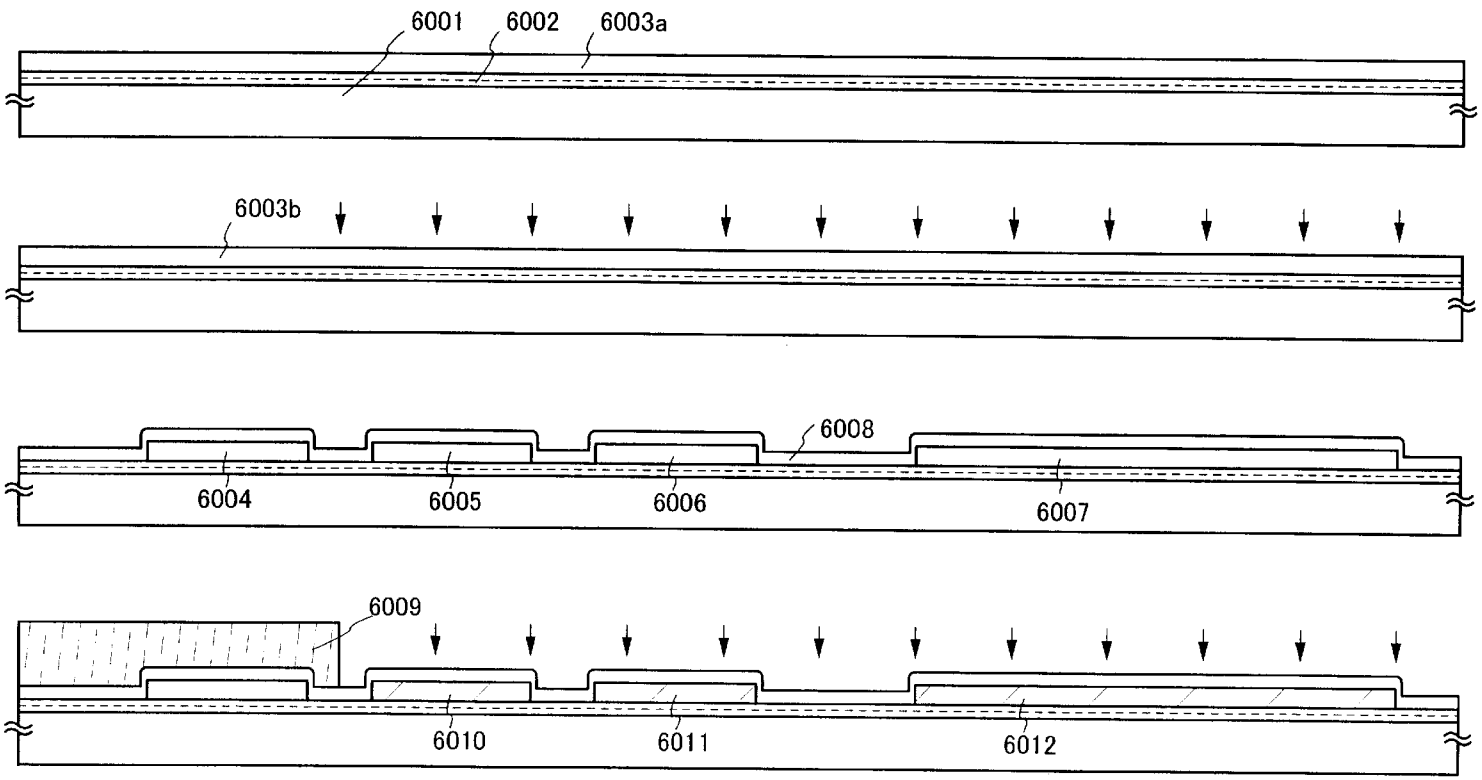
FIGS. 10A to 10D are diagrams showing a method of manufacturing an active matrix liquid crystal display device in accordance with Embodiment 3.

In FIG. 10A, a low alkali glass substrate or a quartz substrate can be used as a substrate (active matrix substrate) 6001. In the present embodiment, the low alkali glass substrate is used as the substrate 6001. In this case, the glass substrate may be thermally treated in advance at a temperature lower than the glass distortion point by 10 to 20° C. On the surface of the substrate 6001 where the TFTs are to be formed, for the purpose of preventing impurity diffusion from the substrate 6001, a base film 6002 of silicon oxide film, silicon nitride film, silicon oxynitride film, or the like is formed. For example, a silicon oxynitride film formed from $SiH_4$, $NH_3$, and $N_2O$ may be formed by plasma CVD at a thickness of 100 nm, and a silicon oxynitride film formed from $SiH_4$ and $N_2O$ may be formed similarly at a thickness of 200 nm to form lamination.

Next, a semiconductor film 6003*a* having the amorphous structure is formed by a known method such as plasma CVD or sputtering at a thickness of from 20 to 150 nm (preferably 30 to 80 nm). In the present embodiment, an amorphous silicon film is formed by plasma CVD at a thickness of 54 nm. Such semiconductor films having the amorphous structure include amorphous semiconductor films, microcrystalline semiconductor films, and the like, and a compound semiconductor film having the amorphous structure such as an amorphous silicon germanium film may also be used. Further, since the base film 6002 and an amorphous silicon film 6003*a* can be formed using the same film forming method, the two may be continuously formed. By not exposing the substrate to the atmosphere after the base film is formed thereon, contamination of the surface can be prevented, and thus variation in the characteristics of the TFTs to be formed thereon and variation in the threshold voltage can be decreased (FIG. 10A).

Then, using known crystallization technique, a crystalline silicon film 6003*b* is formed from the amorphous silicon film 6003*a*. For example, laser crystallization or thermal crystallization (solid phase growth method) may be used. Here, according to the technique disclosed in Japanese Patent Application Laid-Open No. Hei 7-130652, with crystallization using a catalytic element, the crystalline silicon film 6003*b* is formed. Prior to the crystallization process, it is preferable to, depending on the amount of hydrogen contained in the amorphous silicon film, carry out heat treatment at 400 to 500° C. for about an hour to make the amount of hydrogen contained to be 5 atomic % or less. Since the atoms are rearranged to be denser when the amorphous silicon film is crystallized, the thickness of the crystalline silicon film to be formed is smaller than that of the original amorphous silicon film (54 nm in the present embodiment) by 1 to 15% (FIG. 10B).

Then, the crystalline silicon film 6003*b* is patterned to be island shape to form island shape semiconductor layers 6004 to 6007. After that, a mask layer 6008 is formed of silicon oxide film by plasma CVD or sputtering at a thickness of from 50 to 150 nm (FIG. 10C).

Next, a resist mask 6009 is provided, and for the purpose of controlling the threshold voltage, boron (B) is doped all over the surface of island shape semiconductor layers 6005 to 6007 for forming n-channel TFTs as an impurity element imparting p type at the concentration of from about $1\times10^{16}$ to $5\times10^{17}$ atoms/cm$^3$. Boron (B) may be doped by ion doping, or alternatively, may be doped simultaneously with the formation of the amorphous silicon film. The boron (B) doping here is not always needed (FIG. 10D). Thereafter, the resist mask 6009 is removed.

Figures 11A, 11B, 11C, 11D:
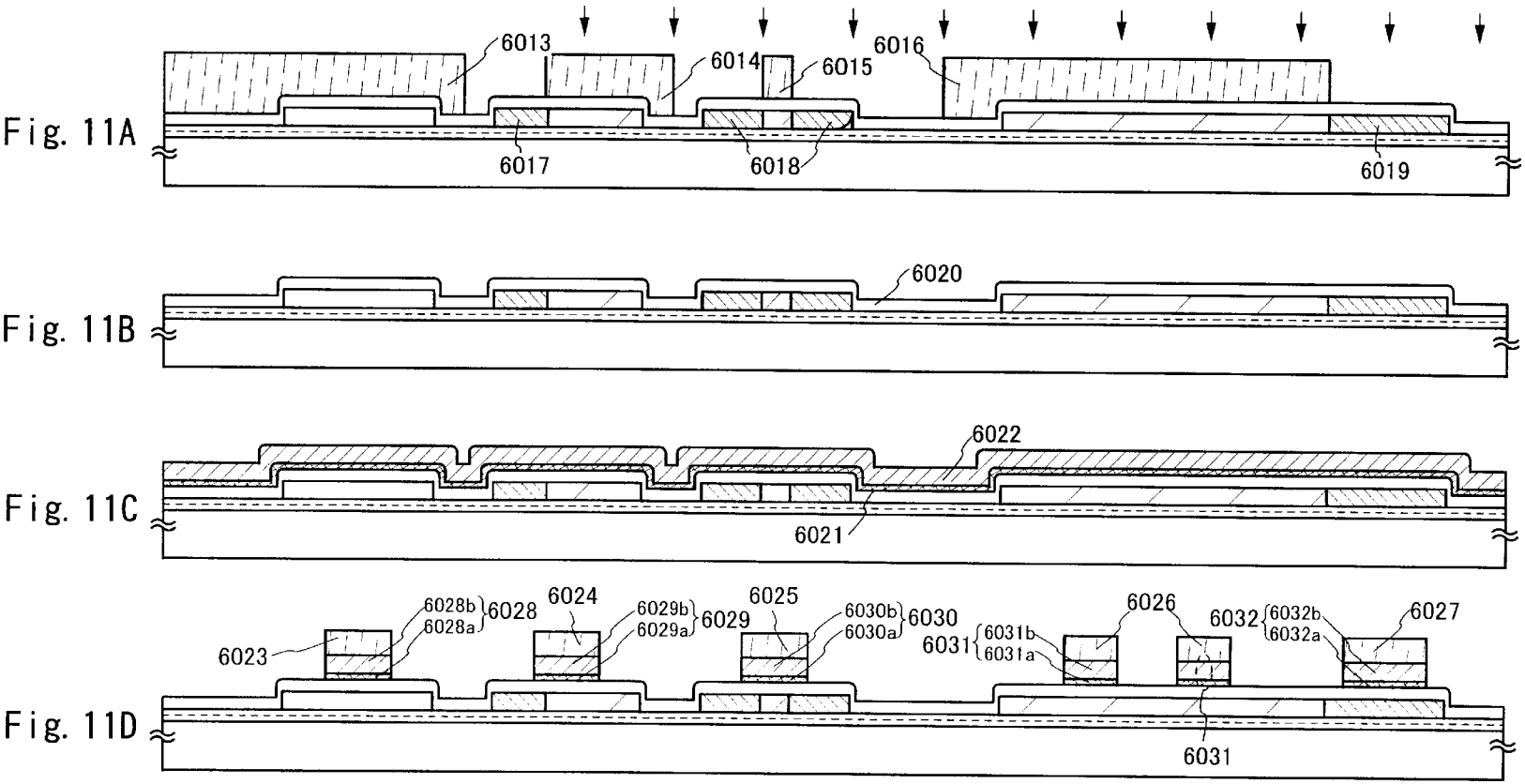
FIGS. 11A to 11D are diagrams showing the method of manufacturing the active matrix liquid crystal display device in accordance with Embodiment 3.

For the purpose of forming the LDD regions of the n-channel TFTs of the driving circuit, an impurity element imparting n type is selectively doped in the island shape semiconductor layers 6010 to 6012, which requires the formation of resist masks 6013 to 6016 in advance. As the impurity element imparting n type, phosphorus (P) or arsenic (As) may be used. Here, ion doping with phosphine ($PH_3$) is used to dope phosphorus (P). The concentration of phosphorus (P) in formed impurity regions 6017 and 6018 is in the range of from $2\times10^{16}$ to $5\times10^{19}$ atoms/cm$^3$. The concentration of the impurity element imparting n type contained in impurity regions 6017 to 6019 formed here is herein referred to as ($n^-$) throughout this application. An impurity region 6019 is a semiconductor layer for forming the storage capacitance of the pixel portion. Phosphorus (P) at the same concentration is also doped in this region (FIG. 11A). After that, the resist masks 6013 to 6016 are removed.

Next, the mask layer 6008 is removed with fluoric acid or the like and an activation step for the impurity elements doped in FIGS. 10D and 11A is carried out. The activation can be carried out by heat treatment in a nitrogen atmosphere at 500 to 600° C. for 1 to 4 hours or laser activation, or the two may be used jointly. In the present embodiment, laser activation is adopted and KrF excimer laser light (wavelength: 248 nm) is used to form linear beams having the oscillating frequency of from 5 to 50 Hz and the energy density of from 100 to 500 mJ/cm$^2$ which scans with the overlapping ratio of from 80 to 98% to treat the whole surface of the substrate having the island shape semiconductor layers formed thereon. It is to be noted that there is no limitation on the conditions of the laser light irradiation, and the conditions may be appropriately decided by the operator.

Then, a gate insulating film 6020 is formed from an insulating film containing silicon by plasma CVD or sputtering at a thickness of from 10 to 150 nm. For example, a silicon oxynitride film at a thickness of 120 nm is formed. A single layer or lamination of other insulating films containing silicon may also be used as the gate insulating film (FIG. 11B).

Next, to form gate electrodes, a first conductive layer is formed. Though the conductive layer may be a single-layer conductive layer, it may be the laminated structure of, for example, two or three layers, depending on the situation. In the present embodiment, a laminated layer consisting of a conductive layer (A) 6021 made from a conductive nitride metallic film and a conductive layer (B) 6022 made from a metallic film is formed. The conductive layer (B) 6022 may be formed of an element selected from tantalum (Ta), titanium (Ti), molybdenum (Mo), and tungsten (W), an alloy containing the foregoing elements as its main constituent, or an alloy film of a combination of the elements (typically Mo—W alloy film or Mo—Ta alloy film). The conductive layer (A) 6021 may be formed of tantalum nitride (TaN), tungsten nitride (WN), titanium nitride (TiN) or molybdenum nitride (MoN). Further, the conductive layer (A) 6021 also may be formed of tungsten silicide, titanium silicide or molybdenum silicide as a substitute material. As to the conductive layer (B) 6022, it is preferable that the concentration of the impurity contained for lowering resistance is reduced. In particular, the concentration of oxygen is desirable to be 30 ppm or less. For example, if the concentration of oxygen is 30 ppm or less, resistance value of 20 ì Ùcm or less can be realized with respect to tungsten (W).

The thickness of the conductive layer (A) 6021 is 10 to 50 nm (preferably 20 to 30 nm), while that of the conductive layer (B) 6022 is 200 to 400 nm (preferably 250 to 350 nm). In the present embodiment, a tantalum nitride film at a thickness of 30 nm is used as the conductive layer (A) 6021, while a Ta film at a thickness of 350 nm is used as the conductive layer (B) 6022, both of which are formed by sputtering. When sputtering is used to form the films, by adding an appropriate amount of Xe or Kr to Ar as the sputtering gas, the internal stress of the film to be formed can be alleviated to prevent the film from peeling off. Note that, although not shown, it is effective to form a silicon film at a thickness of from 2 to 20 nm, doped with phosphorus (P), under the conductive layer (A) 6021. This improves the adherence of the conductive layer to be formed thereon, and oxidation can be prevented. At the same time, a small amount of the alkaline element contained in the conductive layer (A) or the conductive layer (B) can be prevented from dispersing into the gate insulating film 6020 (FIG. 11C).

Then, resist masks 6023 to 6027 are formed and the conductive layers (A) 6021 and (B) 6022 are etched together to form gate electrodes 6028 to 6031, and capacitor wirings 6032. The gate electrodes 6028 to 6031 and the capacitor wiring 6032 are constructed of the conductive layers (A) 6028*a* to 6032*a* and the conductive layers (B) 6028*b* to 6032*b* which are integrally formed. Here, the gate electrodes 6028 to 6030 of TFTs, which constitute the driver circuits, are formed so as to overlap parts of the impurity regions 6017 and 6018 through the gate insulating film 6020 (FIG. 11D).

Figures 12A, 12B, 12C, 12D:
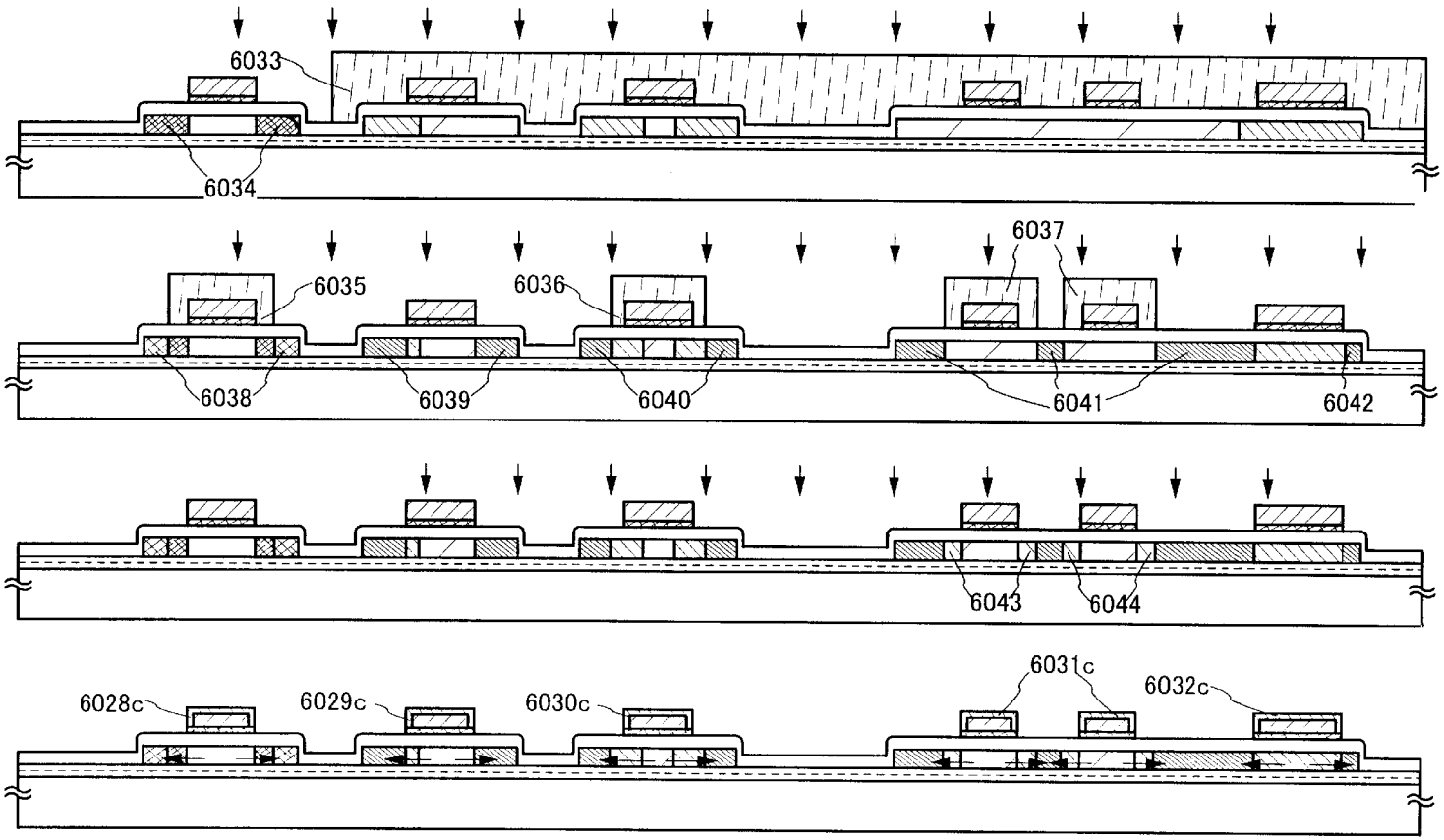
FIGS. 12A to 12D are diagrams showing the method of manufacturing the active matrix liquid crystal display device in accordance with Embodiment 3.

Then, for the purpose of forming the source and drain regions of the p-channel TFT of the driving circuit, a step of doping an impurity element imparting p type is carried out. Here, with the gate electrode 6028 being as the mask, the impurity region is formed in a self-aligning manner. Here, the regions where the n-channel TFTs are to be formed are covered with a resist mask 6033. Impurity regions 6034 are formed by ion doping using diborane ($B_2H_6$). The concentration of boron (B) in these regions is $3\times10^{20}$ to $3\times10^{21}$ atoms/cm$^3$. Thereafter the resist mask 6033 is removed. The concentration of the impurity element imparting p type contained in the impurity regions 6034 formed here is herein referred to as ($p^{++}$) (FIG. 12A).

Next, in the n-channel TFTs, impurity regions to function as source or drain regions are formed. Resist masks 6035 to 6037 are formed and an impurity element imparting n type is doped to form impurity regions 6039 to 6042. This is done by ion doping using phosphine ($PH_3$) with the concentration of phosphorus (P) in these regions being $1\times10^{20}$ to $1\times10^{21}$ atoms/cm$^3$. The concentration of the impurity element imparting n type contained in the impurity regions 6039 to 6042 formed here is herein referred to as ($n^+$) (FIG. 12B).

The impurity regions 6039 to 6042 already contain phosphorus (P) or boron (B) doped in previous steps, but since phosphorus (P) is doped at a sufficiently larger concentration, the influence of phosphorus (P) or boron (B) doped in the previous steps can be neglected. Further, since the concentration of phosphorus (P) doped in the impurity regions 6038 is ½ to ⅓ of that of boron (B) doped in FIG. 12A, the conductivity of p type is secured without any influence on the TFT characteristics.

Then, for the purpose of forming the LDD regions of the n-channel TFT of the pixel portion, a step of doping impurity element imparting n type is carried out. Here, an impurity element imparting n type in a self-aligning manner is doped by ion doping with the gate electrode 6031 as a mask. The concentration of the doped phosphorus (P) is $1\times10^{16}$ to $5\times10^{18}$ atoms/cm$^3$. By carrying out the doping with the concentration lower than that of the impurity elements doped in FIGS. 11A, 12A, and 12B, only impurity regions

6043 and 6044 are actually formed. The concentration of the impurity element imparting n type contained in the impurity regions 6043 and 6044 formed here is herein referred to as ($n^-$) (FIG. 12C).

After that, a heat treatment step is carried out to activate the impurity elements imparting n or p type doped at the respective concentrations. The step can be carried out by furnace annealing, laser annealing, or rapid thermal annealing (RTA). Here, the activation step is carried out by furnace annealing. Heating is carried out at the concentration of oxygen of 1 ppm or less, preferably 0.1 ppm or less in a nitrogen atmosphere at 400 to 800° C., typically 500 to 600° C., in this embodiment 500° C. for four hours. Further, in case of using a quartz substrate having heat resistance as the substrate 6001, a heat treatment may be carried out at 800° C. for 1 hour. Then, the activation of the impurity element can be realized, and an impurity region doped with the impurity element and a channel forming region are satisfactory jointed together. Note that this effect may not be obtained in the case of forming an interlayer film for preventing the Ta film of the gate electrode from peeling off.

In the above heat treatment, conductive layers (C) 6028*c* to 6032*c* are formed at a thickness of 5 to 80 nm on the surface of metallic films 6028*b* to 6032*c* comprising the gate electrodes 6028 to 6031 and the capacitor wiring 6032. For example, tungsten nitride (WN) and tantalum nitride (TaN) can be formed when the conductive layers (B) 6028*b* to 6032*b* are tungsten (W) and tantalum (Ta), respectively. Besides, the conductive layers (C) 6028*c* to 6032*c* can be formed similarly by exposing the gate electrodes 6028 to 6031 and the capacitor wiring 6032 in a plasma atmosphere containing nitrogen using nitrogen or ammonia or the like. Then, a heat treatment is carried out in an atmosphere containing 3 to 100% of hydrogen at 300 to 450° C. for 1 to 12 hours to hydrogenate the island shape semiconductor layers. This process is a process where the dangling bonds in the semiconductor layers are terminated by thermally excited hydrogen. As other means for hydrogenation, plasma hydrogenation (hydrogen excited by plasma is used) may be carried out.

In the case where the island shape semiconductor layers are formed from an amorphous silicon film by crystallization using a catalytic element, a small amount of the catalytic element remains in the island shape semiconductor layers. Of course, it is still possible to complete a TFT in such a condition, but it is more preferable to remove the remaining catalytic element at least from the channel forming region. To utilize the gettering action by phosphorus (P) is one of the means for removing the catalytic element. The concentration of phosphorus (P) necessary for the gettering is about the same as that in the impurity region ($n^+$) formed in FIG. 12B. By the heat treatment in the activation process carried out here, the catalytic element can be gettered from the channel forming regions of the n-channel TFTs and the p-channel TFTs (FIG. 12D).

Figures 13A, 13B, 13C:
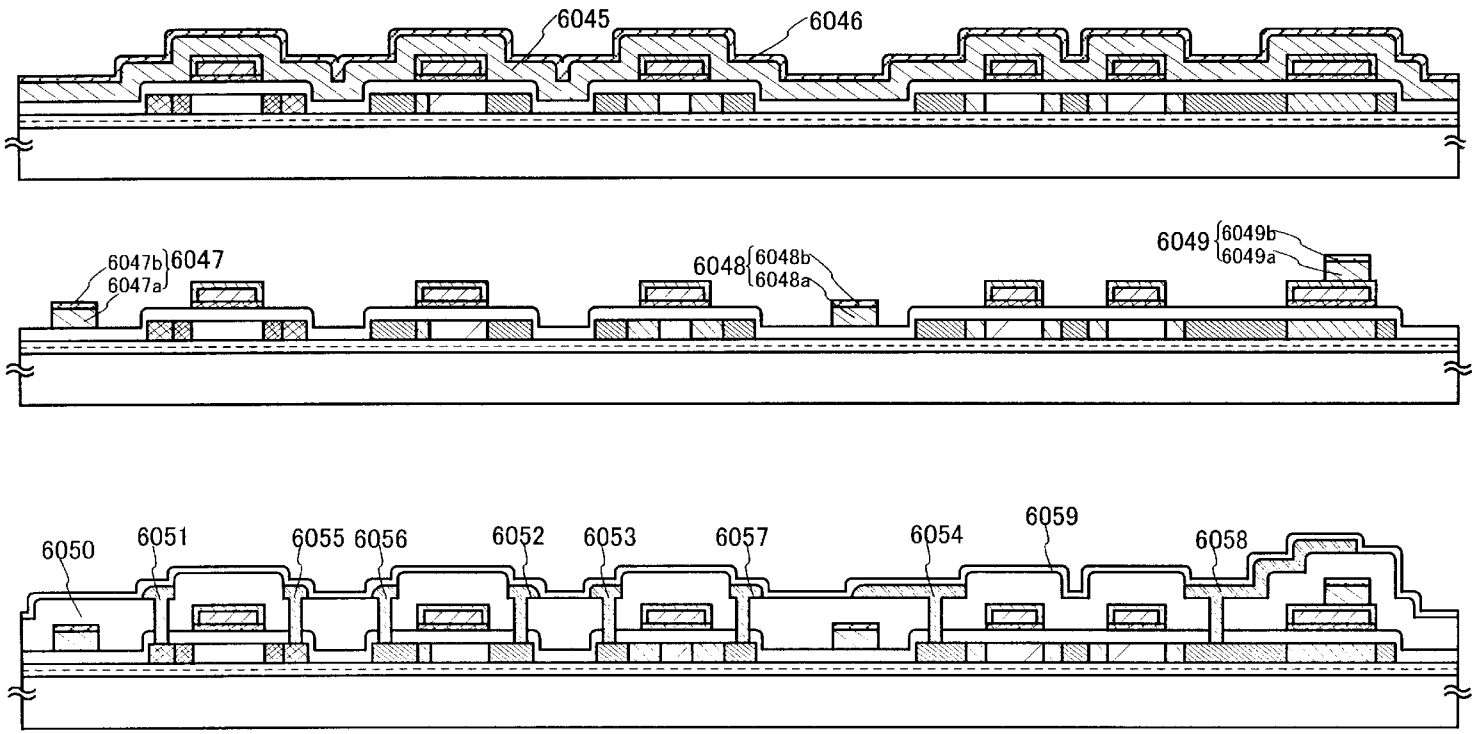
FIGS. 13A to 13C are diagrams showing the method of manufacturing the active matrix liquid crystal display device in accordance with Embodiment 3.

After completing the activation and hydrogenation processes, a second conducting film which is made into a gate wiring (scanning line) is formed. The second conducting film may be formed by a conducting layer (D) having a low resistance material such as aluminum (Al) or copper (Cu) as its main constituents, and a conducting layer (E) composed of titanium (Ti), tantalum (Ta), tungsten (W), or molybdenum (Mo). In Embodiment 3, an aluminum (Al) film containing 0.1 to 2 weight % titanium (Ti) is formed as a conducting layer (D) 6045, and a titanium (Ti) film is formed as a conducting layer (E) 6046. The conducting layer (D) 6045 may be formed having a thickness from 200 to 400 nm (preferably between 250 and 350 nm), and the conducting layer (E) 6046 may be formed with a thickness of 50 to 200 nm (preferably between 100 and 150 nm) (See FIG. 13A).

Then, in order to form a gate wiring (scanning line) connecting a gate electrode, the conducting layer (E) 6046 and the conducting layer (D) 6045 are etched, forming gate wirings (scanning line) 6047 and 6048, and a capacitor wiring 6049. Regarding the etching process, by first removing material from the surface of the conducting layer (E) to a point within the conducting layer (D) by dry etching using a mixed gas of $SiCl_4$, $Cl_2$, and $BCl_3$, and then removing the remainder of the conducting layer (D) by wet etching using a phosphoric acid etching solution, a gate wiring (scanning line) can be formed while retaining selective processability with the base.

A first interlayer insulating film 6050 is formed by a silicon oxide film or a silicon oxynitride film with a thickness of 500 to 1500 nm. Contact holes for reaching source regions or drain regions formed in the respective island shape semiconductor layers are formed next, and source wirings (signal lines) 6051 to 6054, and drain wirings 6055 to 6058 are formed. Although not shown in the figures, a three-layer structure lamination film in which a 100 nm thick Ti film, a 300 nm thick aluminum film containing Ti, and a 150 nm thick Ti film are formed in succession by sputtering in Embodiment 3 for these electrodes.

Next, a silicon nitride film, a silicon oxide film, or a silicon oxynitride film is formed having a thickness from 50 to 500 nm (typically between 100 and 300 nm) as a passivation film 6059. If a hydrogenation process is performed in this state, a desirable result can be obtained with respect to improving the TFT characteristics. For example, heat treatment may be performed for 1 to 12 hours at 300 to 450° C. in an atmosphere containing between 3 and 100% hydrogen. A similar result can also be obtained using a plasma hydrogenation process. Note that open portions may also be formed in the passivation film 6059 in positions at which contact holes for connecting pixel electrodes and the drain wiring will later be formed (See FIG. 13C).

Figure 14:
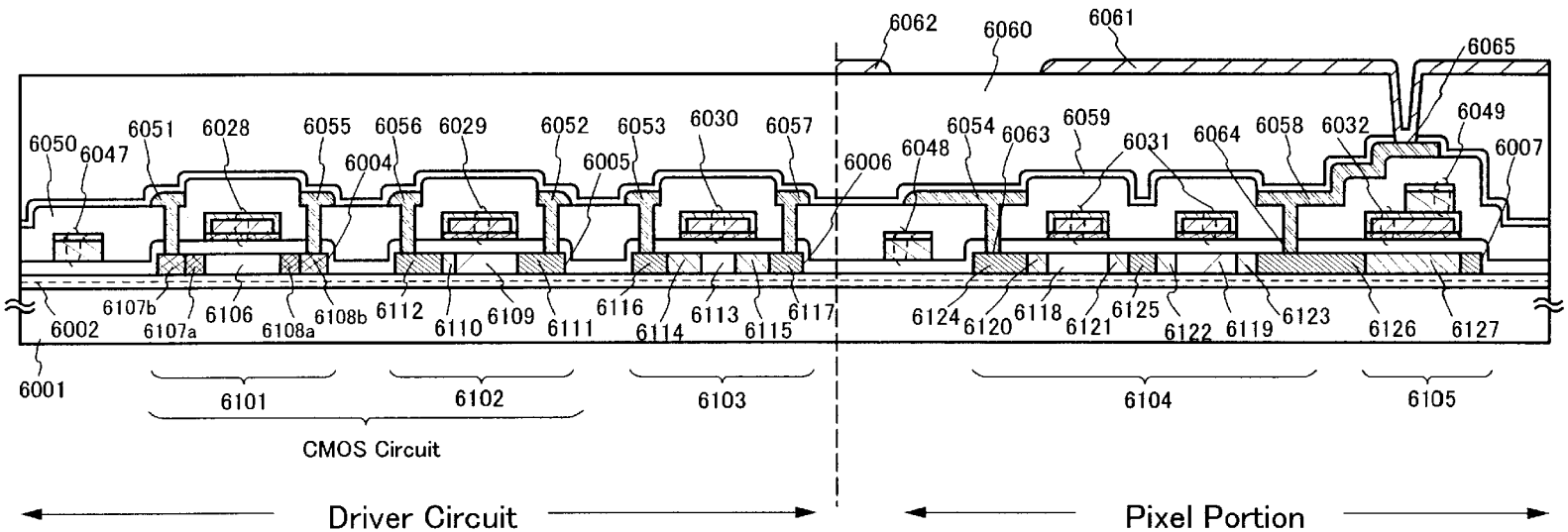
FIG. 14 is a diagram showing the method of manufacturing the active matrix liquid crystal display device in accordance with Embodiment 3.

A second interlayer insulating film 6060 is formed next from an organic resin film having a thickness of 1.0 to 1.5 ì m. Materials such as polyimide, acrylic, polyamide, polyimide amide, and BCB (benzocyclobutene) can be used as the organic resin. The second interlayer insulating film 6060 is formed here by firing at 300° C. after application to the substrate using a thermal polymerization type polyimide. A contact hole for reaching the drain wiring 6058 is then formed in the second interlayer insulating film 6060, and pixel electrodes 6061 and 6062 are formed. A transparent conducting film may be used for the pixel electrodes for a case of a transmitting type liquid crystal display device, and a metallic film may be used for a case of a reflecting type liquid crystal display device. A transmitting type liquid crystal display device is used in Embodiment 3, and therefore an indium tin oxide (ITO) film is formed with a thickness of 100 nm by sputtering (See FIG. 14).

The substrate having the driver circuit TFT and the pixel TFT of the pixel portion on the same substrate can thus be completed. A p-channel TFT 6101, a first n-channel TFT 6102, and a second n-channel TFT 6103 are formed in the driver circuit, and a pixel TFT 6104 and a storage capacitor 6105 are formed in the pixel portion. For convenience, this type of substrate is referred to as an active matrix substrate throughout this specification.

In the p-channel TFT 6101 of the driver circuit, the island shape semiconductor layer 6004 has a channel forming region 6106, source regions 6107*a* and 6107*b*, and drain regions 6108*a* and 6108*b*. In the first n-channel TFT 6102, the island shape semiconductor layer 6005 has a channel forming region 6109, an LDD region 6110 overlapping the gate electrode 6029 (this type of LDD region is hereafter referred to as Lov), a source region 6111, and a drain region 6112. The length of the longitudinal direction of the channel of this Lov region is from 0.5 to 3.0 ì m, preferably from 1.0 to 1.5 ì m. In the second n-channel TFT 6103, the island shape semiconductor layer 6006 has a channel forming region 6113, LDD regions 6114 and 6115, a source region 6116, and a drain region 6117. An LDD region which does not overlap the Lov region and the gate electrode 6030 is formed as this LDD region (this type of LDD region is hereafter referred to as Loff). The length of the longitudinal direction of the channel of this Loff region is from 0.3 to 2.0 ì m, preferably between 0.5 and 1.5 ì m. In the pixel TFT 6104, the island shape semiconductor layer 6007 has channel forming regions 6118 and 6119, Loff regions 6120 to 6123, and source or drain regions 6124 to 6126. The length of the longitudinal direction of the channel of this Loff region is from 0.5 to 3.0 ì m, preferably between 1.5 and 2.5 ì m. In addition, the storage capacitor 6105 is formed from the capacitor wirings 6032 and 6049, an insulating film composed of the same material as the gate insulating film, and a semiconductor layer 6127, to which an impurity element which imparts n-type conductivity is added, connected to the drain region 6126. The pixel TFT 6104 is shown as a double gate structure in FIG. 14, but a single gate structure may also be used, and a multi-gate structure in which a plurality of gate electrodes are formed may also be used without hindrance.

The structure of the TFTs composing each circuit is optimized in response to the specifications required by the pixel TFT and the driver circuit in Embodiment 3, and it is thus possible to improve the operating performance and the reliability of the image display device.

Next, a process of manufacturing a transmitting type liquid crystal display device based on the active matrix substrate manufactured in accordance with the above processes is explained.

Figure 15:
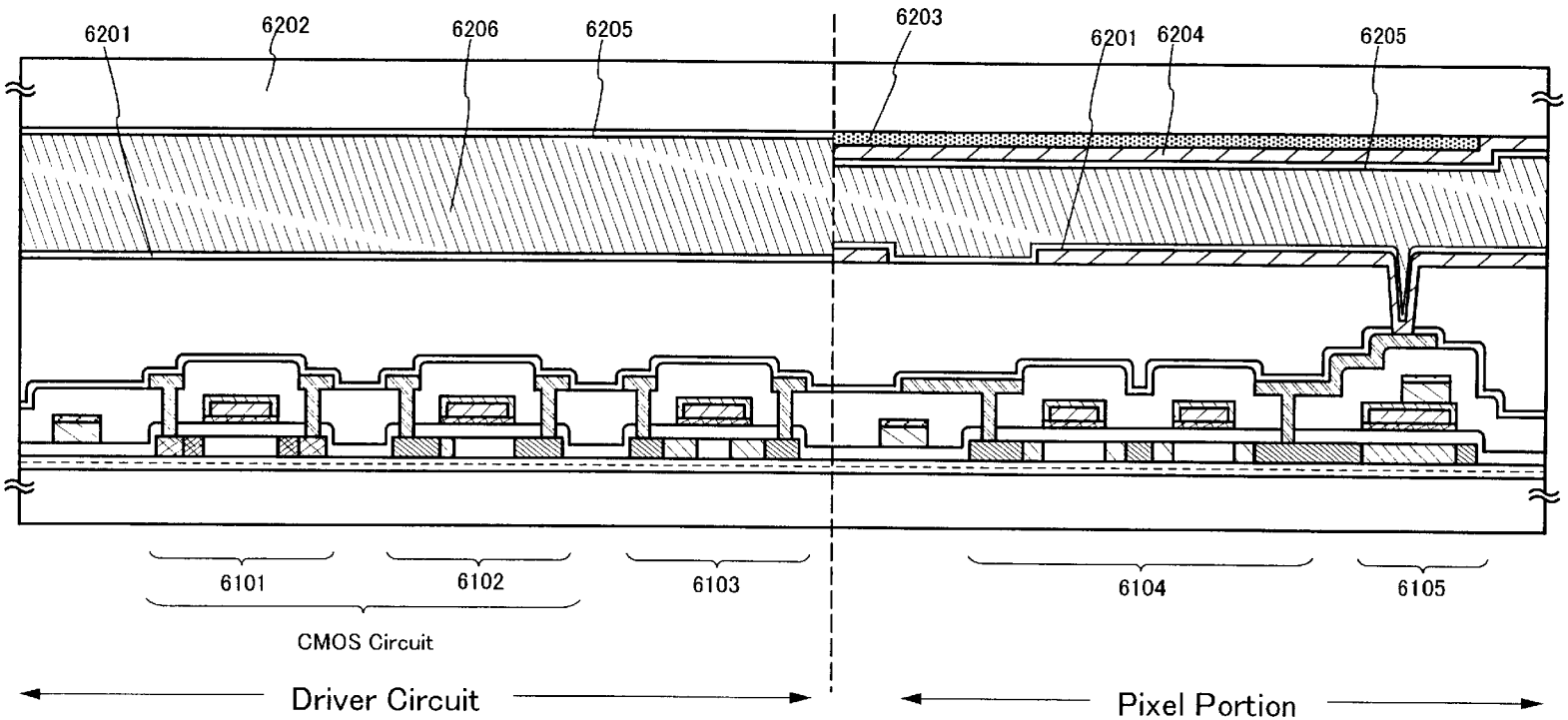
FIG. 15 is a diagram showing the method of manufacturing the active matrix liquid crystal display device in accordance with Embodiment 3.

Refer to FIG. 15. An orientation film 6201 is formed on the active matrix substrate in the state of FIG. 14. Polyimide is used in the orientation film 6201 in Embodiment 3. An opposing substrate is prepared next. The opposing substrate is structured by a glass substrate 6202, a light shielding film 6203, an opposing electrode 6204 made from a transparent conducting film, and an orientation film 6205.

Note that, in Embodiment 3, a polyimide film is used in the orientation film so that liquid crystal molecules are oriented parallel to the substrate. Note also that, by performing a rubbing process after forming the orientation films, the liquid crystal molecules are given a certain fixed pre-tilt angle and a parallel orientation.

Having gone through the above processes, the active matrix substrate and the opposing substrate are next joined through a means such as a sealing material or spacers (both not shown in the figure) in accordance with a known cell construction process. A liquid crystal 6206 is then injected between both substrates, and this is completely sealed by a sealant (not shown in the figure). A transmitting type liquid crystal display device like that shown in FIG. 15 is therefore completed.

Note that a TFT formed in accordance with the above processes has a top gate structure, but the present invention can also be applied to a bottom gate structure TFT and to TFT having other structures.

Further, the image display device manufactured in accordance with the above processes is a transmitting type liquid crystal display device, but the present invention can also be applied to a reflecting type liquid crystal display device.

[Embodiment 4]

Electronic equipment into which an active matrix image display device using a driver circuit of the present invention is incorporated, are explained in Embodiment 4. The following can be given as examples of this type of electronic equipment: a portable information terminal (such as an electronic diary, a mobile computer, and a portable telephone), a video camera, a still camera, a personal computer, and a television. Examples of these are shown in FIGS. 16A to 16F, FIGS. 17A to 17D, and FIGS. 18A to 18D.

Figure 16A:
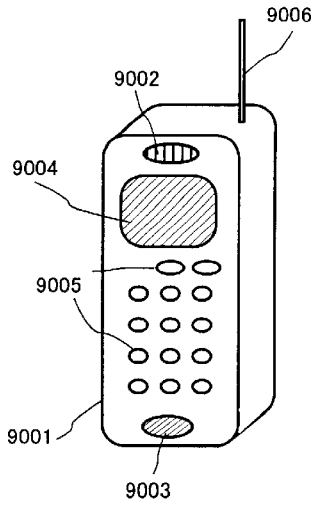
FIGS. 16A to 16F are diagrams showing examples of electronic equipment using the present invention.

FIG. 16A is a portable telephone, and is composed of a main body 9001, an audio output portion 9002, an audio input portion 9003, a display portion 9004, operation switches 9005, and an antenna 9006. The present invention can be applied to the display portion 9004.

Figure 16B:
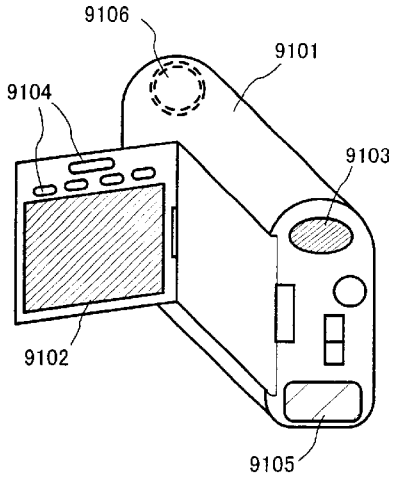

FIG. 16B is a video camera, and is composed of a main body 9101, a display portion 9102, an audio input portion 9103, operation switches 9104, a battery 9105, and an image receiving portion 9106. The present invention can be applied to the display portion 9102.

Figure 16C:
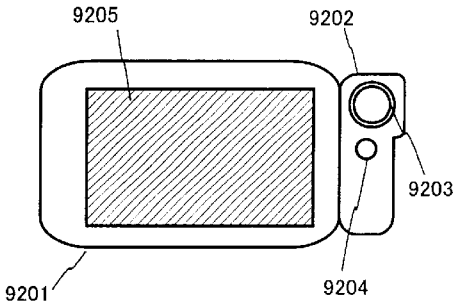

FIG. 16C is a mobile computer, which is one type of personal computer, or a portable type information terminal, and is composed of a main body 9201, a camera portion 9202, an image receiving portion 9203, operation switches 9204, and a display portion 9205. The present invention can be applied to the display portion 9205.

Figure 16D:
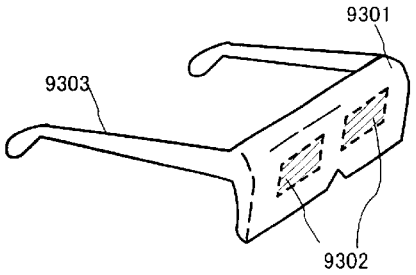

FIG. 16D is a head mounted display (goggle type display), and is composed of a main body 9301, a display portion 9302, and an arm portion 9303. The present invention can be applied to the display portion 9302.

Figure 16E:
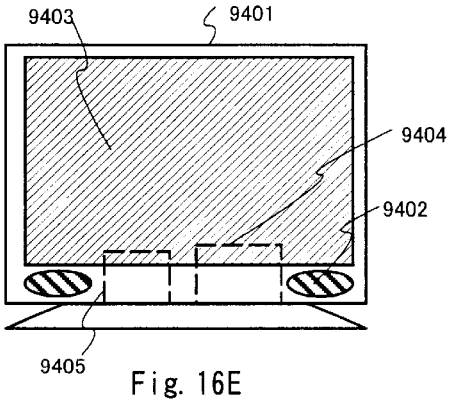

FIG. 16E is a television, and is composed of components such as a main body 9401, speakers 9402, a display portion 9403, a signal receiving device 9404, and an amplifying device 9405. The present invention can be applied to the display portion 9402.

Figure 16F:
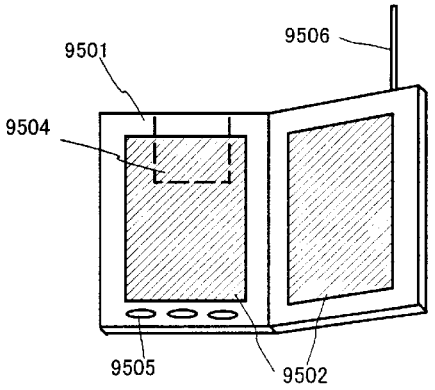

FIG. 16F is a portable book, and is composed of a main body 9501, a display portion 9502, a recording medium 9504, operation switches 9504, and an antenna 9506, and is used for displaying data recorded on a mini-disk (MD) or a DVD (digital versatile disc), and for displaying data received by the antenna. The present invention can be applied to the display portion 9502.

Figure 17A:
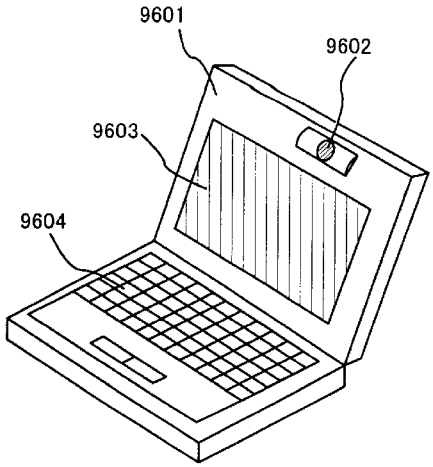
FIGS. 17A to 17D are diagrams showing examples of electronic equipment using the present invention.

FIG. 17A is a personal computer, and is composed of a main body 9601, an image input portion 9602, a display portion 9603, and a keyboard 9604. The present invention can be applied to the display portion 9603.

Figure 17B:
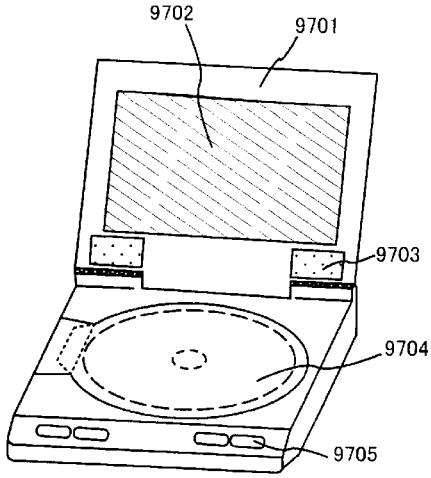

FIG. 17B is a player using a recording medium on which a program is recorded (hereafter referred to as a recording medium), and is composed of a main body 9701, a display portion 9702, a speaker portion 9703, a recording medium 9704, and operation switches 9705. Note that media such as a DVD and a CD can be used as the recording medium for this device, and that the player can be used for music appreciation, film appreciation, games, and the Internet. The present invention can be applied to the display portion 9702.

Figure 17C:
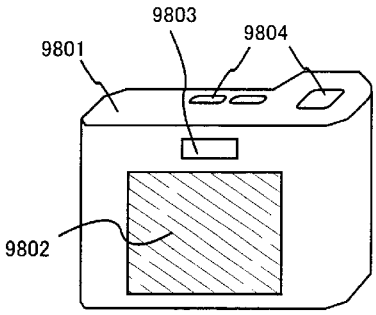

FIG. 17C is a digital camera, and is composed of a main body 9801, a display portion 9802, an eyepiece portion 9803, operation switches 9804, and an image receiving portion (not shown in the figure). The present invention can be applied to the display portion 9802.

Figure 17D:
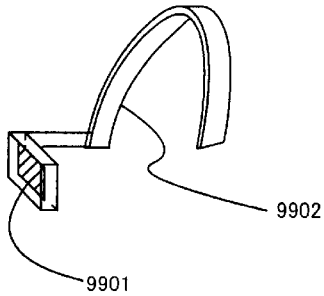

FIG. 17D is a head mount display for one eye, and is composed of a display portion 9901 and a head mount portion 9902. The present invention can be applied to the display portion 9901.

Figure 18A:
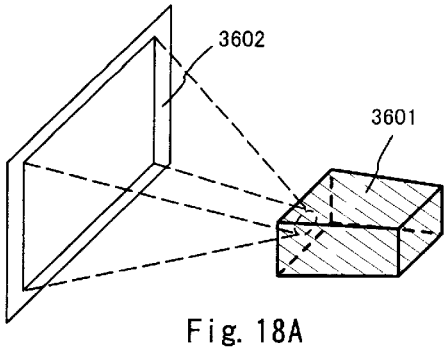
FIGS. 18A to 18D are diagrams showing structures of projecting type liquid crystal display devices.

FIG. 18A is a front type projector, and is composed of a projecting apparatus 3601 and a screen 3602.

Figure 18B:
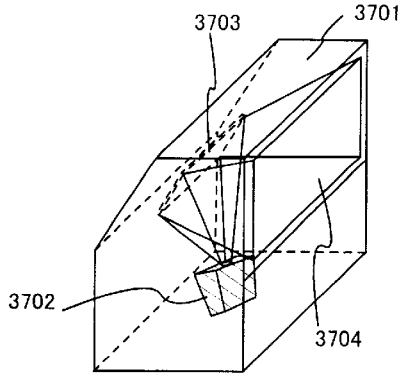

FIG. 18B is a rear type projector, and is composed of a main body 3701, a projecting apparatus 3702, a mirror 3703, and a screen 3704.

Figure 18C:
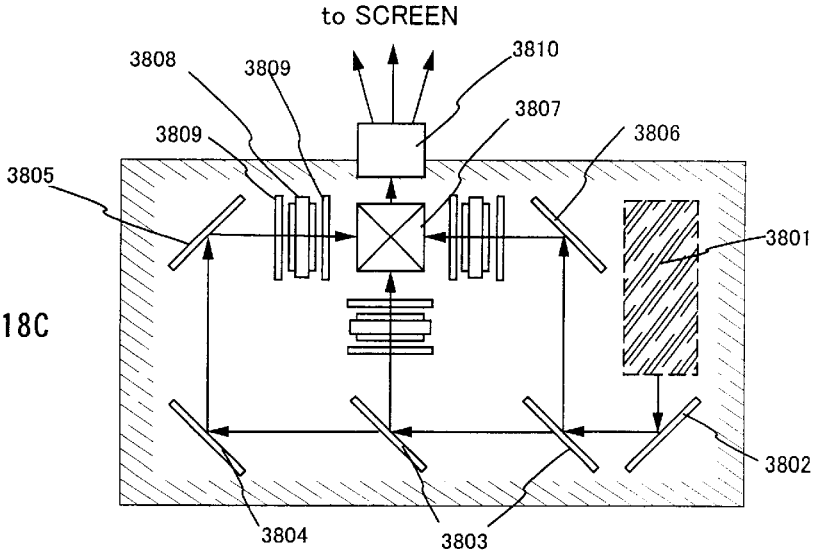

Note that an example of the structure of the projecting apparatuses 3601 and 3702 of FIG. 18A and FIG. 18B is shown in FIG. 18C. The projecting apparatuses 3601 and 3702 are composed of a light source optical system 3801, mirrors 3802 and 3804 to 3806, a dichroic mirror 3803, a beam splitter 3807, a liquid crystal display portion 3808, a phase difference plate 3809, and a projecting optical system 3810. The projecting optical system 3810 is an optical system including a plurality of projecting lenses. A three plate type example is shown in Embodiment 4, but there are no particular limitations, and a single plate type may also be used, for example. Further, optical systems such as an optical lens, a film having a light polarizing function, a film for regulating the phase, and an IR film may be suitably placed in the optical path shown by the arrow in FIG. 18C by the operator. The present invention can be applied to the liquid crystal display portion 3808.

Figure 18D:
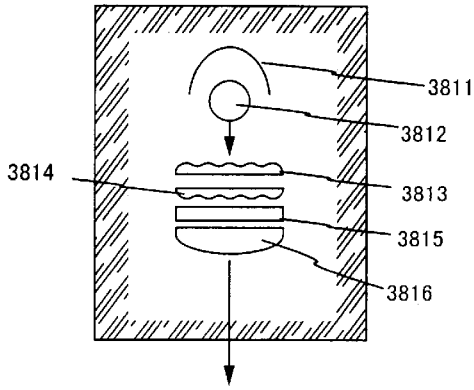
Figure 19:
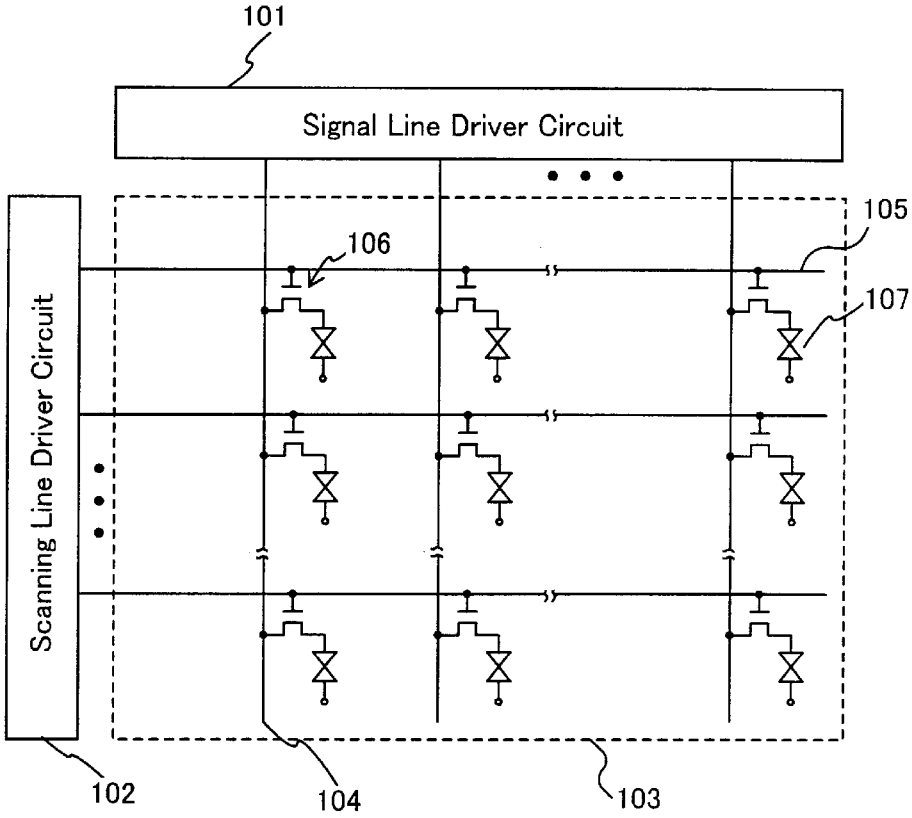
Fig. 19 (PRIOR ART)
FIG. 19 is a schematic diagram of an active matrix liquid crystal display device.
Figure 20:
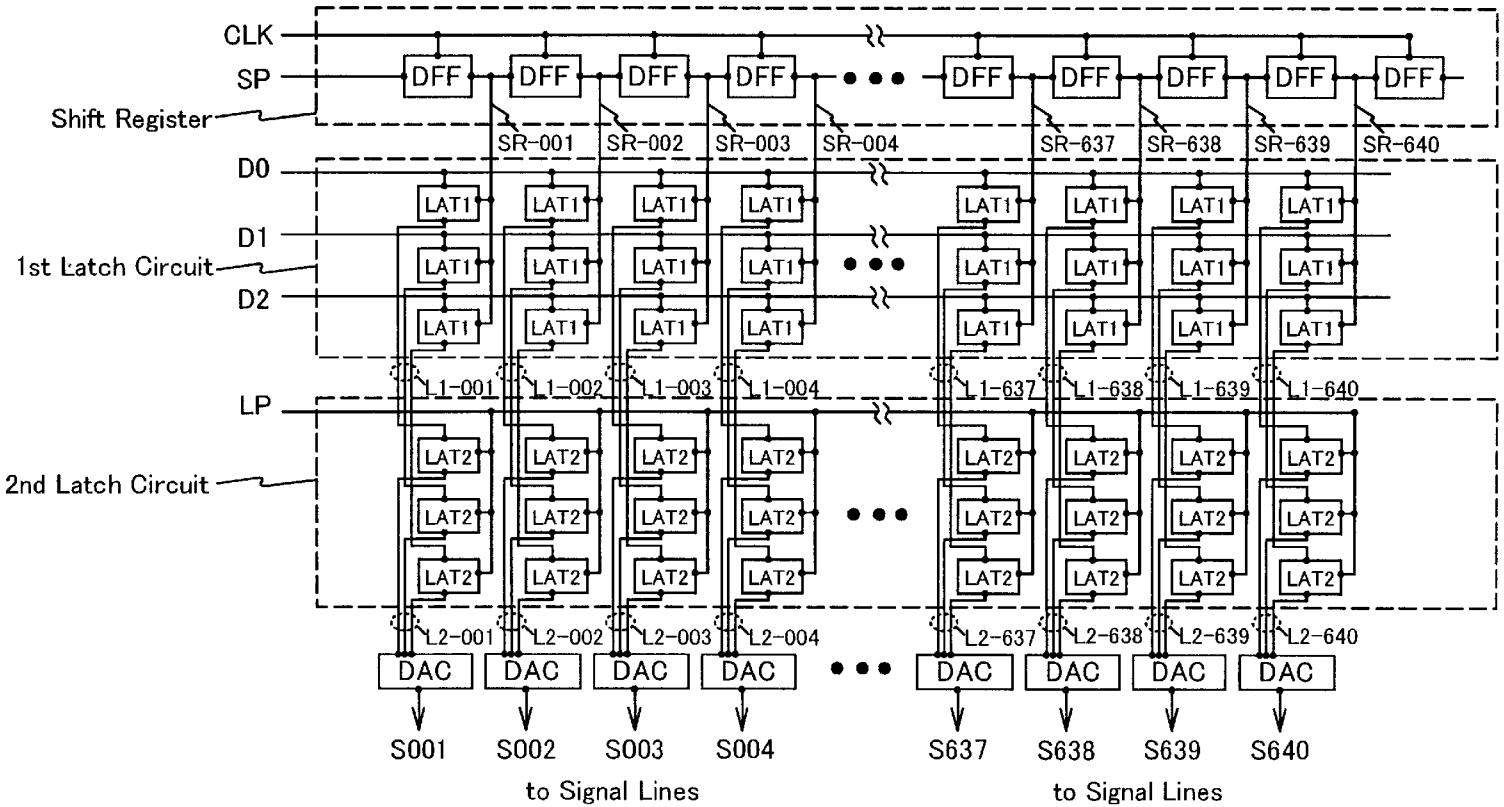
Fig. 20 (PRIOR ART)
FIG. 20 is a schematic diagram of a conventional digital type signal line driver circuit.
Figure 21:
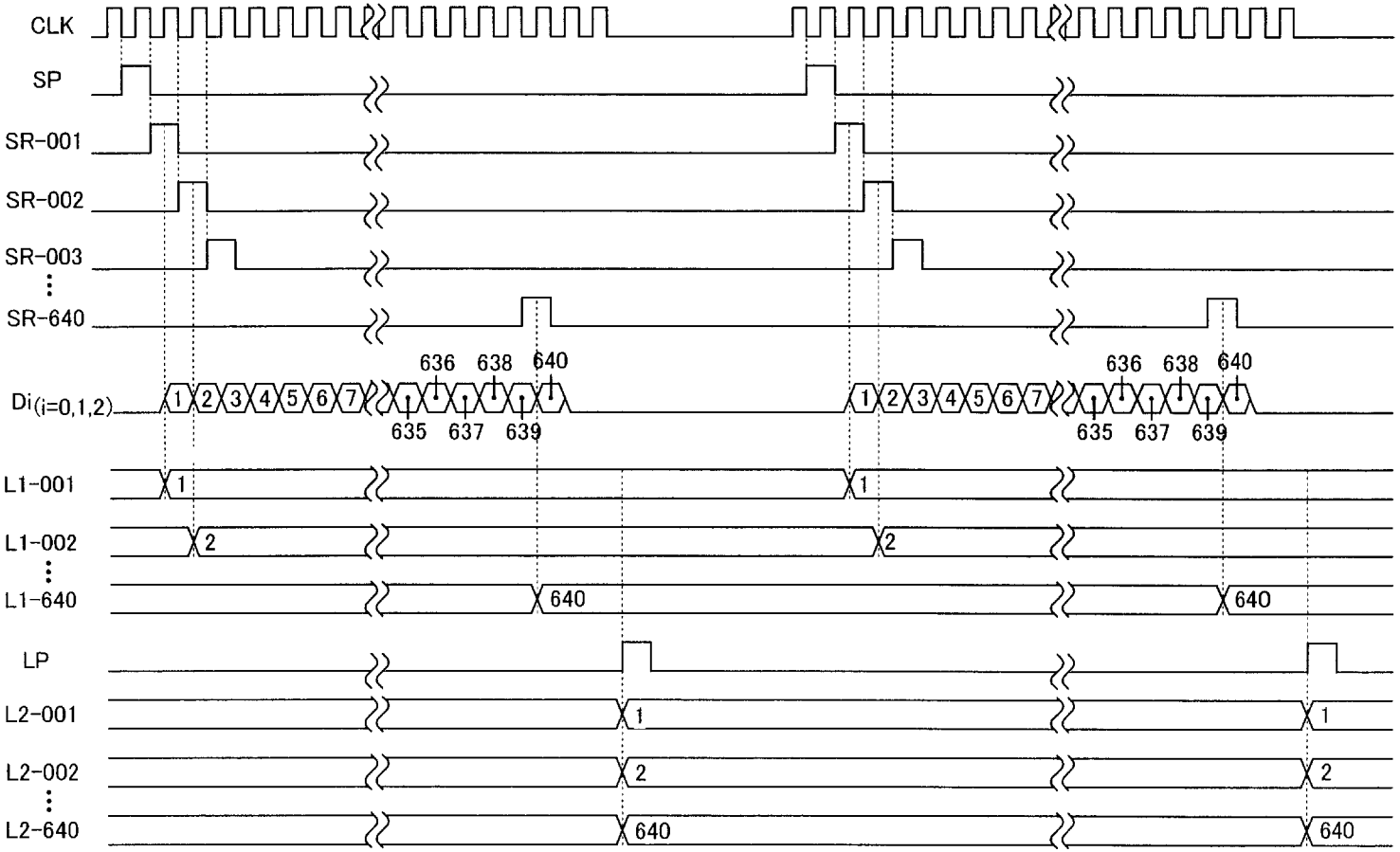
Fig. 21 (PRIOR ART)
FIG. 21 is a diagram showing a timing chart of a conventional digital type signal line driver circuit.

Furthermore, FIG. 18D is a diagram showing one example of the light source optical system 3801 in FIG. 18C. In Embodiment Mode 4, the light source optical system 3801 is composed of a reflector 3811, a light source 3812, lens arrays 3813 and 3814, a polarizing transformation element 3815, and a condenser lens 3816. Note that the light source optical system shown in FIG. 18D is one example, and the light source optical system is not particularly limited to the structure shown in the figure. For example, optical systems such as an optical lens, a film having a light polarizing function, a film for regulating the phase, and an IR film may be suitably added by the operator to the light source optical system.

The applicable scope of the present invention of this specification is thus extremely wide, and the present invention can be implemented when manufacturing electronic equipment of all fields using the image display device.

EFFECT OF THE INVENTION

A driver circuit of an image display device in accordance with the present invention is effective in making the image display device small size because the surface area of a signal line driver circuit can be made greatly smaller, and in addition is effective in lowering the cost of an image display device and in increasing yield.

What is claimed is:

1. An active matrix image display device having a driver circuit, said driver circuit comprising:

a first memory circuit for storing an in-bit digital image signal (where m is a natural number);

a second memory circuit for storing an output signal of said first memory circuit; and a D/A converter circuit for converting an output signal of said second memory circuit to an analog signal, wherein said first memory circuit and said second memory circuit perform n storing operations (where n is a natural number greater than or equal to 2) within a time corresponding to one horizontal scan period, wherein the number of D/A converter circuits is equal to the number of horizontal direction signal lines divided by n, and wherein each of the number of said first memory circuits and the number of said second memory circuits is (m×k)/n when the number of effective horizontal direction signal lines is k (where n is a natural number greater than or equal to 2).

2. An active matrix image display device according to claims 1, wherein said first memory circuit is controlled in accordance with a shift register.

3. An active matrix image display device according to claim 1, wherein said first memory circuit is controlled in accordance with a decoder.

4. An active matrix image display device according to claim 1, wherein said D/A converter circuit is a ramp type D/A converter circuit.

5. An active matrix image display device according to claim 1, wherein said driver circuit is structured by a polysilicon thin film transistor.

6. An active matrix image display device according to claim 1, wherein said driver circuit is structured by a single crystal transistor.

7. An active matrix image display device according to claim 1, wherein said active matrix image display device is incorporated into an electronic equipment selected from the group consisting of a portable telephone, a video camera, a mobile computer, a head mounted display, a television, a portable book, a personal computer, a player, a digital camera, a front type projector, and a rear type projector.

8. An active matrix image display device according to claim 1, wherein said first memory circuit and said second memory circuit are latch circuits.

9. An active matrix image display device according to claim 8, wherein each of said latch circuits is structured by an analog switch and a storage capacitor.

10. An active matrix image display device according to claim 8, wherein each of said latch circuits is structured by a clocked inverter.

11. An active matrix image display device according to claim 8, wherein each of said latch circuits is structured by an analog switch and a plurality of inverters.

12. An active matrix image display device having a driver circuit, said driver circuit comprising:

a first memory circuit for storing an in-bit digital image signal (where m is a natural number);

a second memory circuit for storing an output signal of said first memory circuit; and a D/A converter circuit for converting an output signal of said second memory circuit to an analog signal, wherein said first memory circuit and said second memory circuit perform n storing operations (where n is a natural number greater than or equal to 2) within a time corresponding to one horizontal scan period, wherein the number of D/A converter circuits is equal to the number of horizontal direction signal lines divided by n.

13. An active matrix image display device according to claims 12, wherein said first memory circuit is controlled in accordance with a shift register.

14. An active matrix image display device according to claim 12, wherein said first memory circuit is controlled in accordance with a decoder.

15. An active matrix image display device according to claim 12, wherein said D/A converter circuit is a ramp type D/A converter circuit.

16. An active matrix image display device according to claim 12, wherein said driver circuit is structured by a polysilicon thin film transistor.

17. An active matrix image display device according to claim 12, wherein said driver circuit is structured by a single crystal transistor.

18. An active matrix image display device according to claim 12, wherein said active matrix image display device is incorporated into an electronic equipment selected from the group consisting of a portable telephone, a video camera, a mobile computer, a head mounted display, a television, a portable book, a personal computer, a player, a digital camera, a front type projector, and a rear type projector.

19. An active matrix image display device according to claim 12, wherein said first memory circuit and said second memory circuit are latch circuits.

20. An active matrix image display device according to claim 19, wherein each of said latch circuits is structured by an analog switch and a storage capacitor.

21. An active matrix image display device according to claim 19, wherein each of said latch circuits is structured by a clocked inverter.

22. An active matrix image display device according to claim 19, wherein each of said latch circuits is structured by an analog switch and a plurality of inverters.

23. An active matrix image display device having a driver circuit, said driver circuit comprising:

a first memory circuit for storing an in-bit digital image signal (where m is a natural number);

a second memory circuit for storing an output signal of said first memory circuit; and a D/A converter circuit for converting an output signal of said second memory circuit to an analog signal, wherein said second memory circuit is divided into a plurality of groups which are divided in a horizontal direction, and wherein each of said groups performs n storing operations (where n is a natural number greater than or equal to 2) at different timings in one horizontal scan period.

24. An active matrix image display device according to claims 23, wherein said first memory circuit is controlled in accordance with a shift register.

25. An active matrix image display device according to claim 23, wherein said first memory circuit is controlled in accordance with a decoder.

26. An active matrix image display device according to claim 23, wherein the number of D/A converter circuits is equal to the number of horizontal direction signal lines divided by n.

27. An active matrix image display device according to claim 23, wherein said D/A converter circuit is a ramp type D/A converter circuit.

28. An active matrix image display device according to claim 23, wherein said driver circuit is structured by a polysilicon thin film transistor.

29. An active matrix image display device according to claim 23, wherein said driver circuit is structured by a single crystal transistor.

30. An active matrix image display device according to claim 23, wherein said active matrix image display device is incorporated into an electronic equipment selected from the group consisting of a portable telephone, a video camera, a mobile computer, a head mounted display, a television, a portable book, a personal computer, a player, a digital camera, a front type projector, and a rear type projector.

31. An active matrix image display device according to claim 23, wherein said first memory circuit and said second memory circuit are latch circuits.

32. An active matrix image display device according to claim 31, wherein each of said latch circuits is structured by an analog switch and a storage capacitor.

33. An active matrix image display device according to claim 31, wherein each of said latch circuits is structured by a clocked inverter.

34. An active matrix image display device according to claim 31, wherein each of s id latch circuits is structured by an analog switch and a plurality of inverters.

35. An active matrix image display device having a driver circuit, said driver circuit comprising:

a first memory circuit for storing an in-bit digital image signal (where m is a natural number);

a second memory circuit for storing an output signal of said first memory circuit; and a D/A converter circuit for converting an output signal of said second memory circuit to an analog signal, wherein said first memory circuit is controlled in accordance with shift register, wherein said shift register has n clock stop periods (where n is a natural number greater than or equal to 2) in one horizontal scan period, and wherein said second memory circuit performs a storage operation in each stop period.

36. An active matrix image display device according to claim 35, wherein said shift register performs n scans within a time corresponding to one horizontal scan period.

37. An active matrix image display device according to claim 35, wherein the number of D/A converter circuits is equal to the number of horizontal direction signal lines divided by n.

38. An active matrix image display device according to claim 35, wherein said D/A converter circuit is a ramp type D/A converter circuit.

39. An active matrix image display device according to claim 35, wherein said driver circuit is structured by a polysilicon thin film transistor.

40. An active matrix image display device according to claim 35, wherein said driver circuit is structured by a single crystal transistor.

41. An active matrix image display device according to claim 35, wherein said active matrix image display device is incorporated into an electronic equipment selected from the group consisting of a portable telephone, a video camera, a mobile computer, a head mounted display, a television, a portable book, a personal computer, a player, a digital camera, a front type projector, and a rear type projector.

42. An active matrix image display device according to claim 35, wherein said first memory circuit and said second memory circuit are latch circuits.

43. An active matrix image display device according to claim 42, wherein each of said latch circuits is structured by an analog switch and a storage capacitor.

44. An active matrix image display device according to claim 42, wherein each of said latch circuits is structured by a clocked inverter.

45. An active matrix image display according to claim 42, wherein each of said latch circuits is structured by an analog switch and a plurality of inverters.

* * * * *

UNITED STATES PATENT AND TRADEMARK OFFICE

CERTIFICATE OF CORRECTION

PATENT NO. : 6,693,616 B2
DATED : February 17, 2004
INVENTOR(S) : Yasushi Kubota et al.

It is certified that error appears in the above-identified patent and that said Letters Patent is hereby corrected as shown below:

Title page,
Item [73], after "Atsugi (JP)", insert -- ; Sharp Kabushiki Kaisha, Osaka, (JP) --.

Signed and Sealed this

Twelfth Day of October, 2004

JON W. DUDAS
*Director of the United States Patent and Trademark Office*